US010290402B2

(12) United States Patent
Yoneda

(10) Patent No.: US 10,290,402 B2
(45) Date of Patent: May 14, 2019

(54) CHIP RESISTOR AND METHOD OF MAKING THE SAME

(71) Applicant: ROHM CO., LTD., Kyoto (JP)

(72) Inventor: Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 34 days.

(21) Appl. No.: 15/457,423

(22) Filed: Mar. 13, 2017

(65) Prior Publication Data

US 2017/0271053 A1 Sep. 21, 2017

(30) Foreign Application Priority Data

Mar. 15, 2016 (JP) ..... 2016-051060

(51) Int. Cl.

| | |
|---|---|
| ***H01C 1/012*** | (2006.01) |
| ***H01C 1/142*** | (2006.01) |
| ***H01C 17/00*** | (2006.01) |
| ***H01C 17/28*** | (2006.01) |
| ***H01C 1/148*** | (2006.01) |
| ***H01C 7/00*** | (2006.01) |
| *H01C 17/242* | (2006.01) |

(52) U.S. Cl.

CPC ..... *H01C 1/142* (2013.01); *H01C 1/012* (2013.01); *H01C 1/148* (2013.01); *H01C 7/003* (2013.01); *H01C 17/006* (2013.01); *H01C 17/288* (2013.01); *H01C 17/242* (2013.01); *H01C 17/281* (2013.01)

(58) Field of Classification Search

CPC ..... H01C 1/142; H01C 1/012; H01C 1/148; H01C 7/003; H01C 17/006; H01C 17/288; H01C 17/242

USPC ..... 338/313, 195

See application file for complete search history.

(56) References Cited

U.S. PATENT DOCUMENTS 6,242,999 B1 * 6/2001 Nakayama ..... H01C 1/14 338/307

6,943,662 B2 * 9/2005 Tanimura ..... H01C 1/142 257/537

(Continued)

FOREIGN PATENT DOCUMENTS

JP 2015-50234 3/2015

OTHER PUBLICATIONS

JP 2011-165752, Feb. 2010, Hayashi et al., Machine translation. (Year: 2010).*

*Primary Examiner* — Kyung S Lee

(74) *Attorney, Agent, or Firm* — Hamre, Schumann, Mueller & Larson, P.C.

(57) ABSTRACT

The present invention provides a chip resistor and a method of making the same for alleviating stress resulted from thermal expansion difference and thus suppressing cracks. A chip resistor includes: a substrate, having a carrying surface and a mounting surface facing away from each other; a pair of upper electrodes, disposed at two ends of the carrying surface; a resistor, disposed on the carrying surface and between the pair of upper electrodes, and electrically connected to the pair of upper electrodes; a stress relaxation layer having flexibility and formed on the mounting surface of the substrate; a metal thin film layer, formed on a surface of the stress relaxation layer opposite to the substrate; a side electrode for electrically connecting the upper electrodes and the metal thin film layer; and a plating layer covering the side electrode and the metal thin film layer.

51 Claims, 28 Drawing Sheets

(56) References Cited

U.S. PATENT DOCUMENTS

| | | | | |
|---|---|---|---|---|
| 7,782,173 | B2 * | 8/2010 | Urano | H01C 1/012 338/307 |
| 9,336,931 | B2 * | 5/2016 | Tsai | H01C 1/142 |
| 9,704,621 | B2 * | 7/2017 | Ogawa | H01C 1/142 |
| 2008/0094169 | A1 * | 4/2008 | Kinoshita | H01C 1/06 338/309 |
| 2008/0211619 | A1 * | 9/2008 | Belman | H01C 17/288 338/309 |
| 2010/0201477 | A1 * | 8/2010 | Yang | H01C 1/032 338/309 |
| 2014/0333411 | A1 * | 11/2014 | Yoneda | H01C 1/142 338/314 |

* cited by examiner

CHIP RESISTOR AND METHOD OF MAKING THE SAME

BACKGROUND

The present invention relates to a chip resistor and a method of making the chip resistor. There are many conventional chip resistors, for example, a chip resistor in Patent Literature 1. In the chip resistor of Patent Literature 1, a resistor is formed on an upper surface of a substrate, and back electrodes are formed at two ends of a lower surface of the substrate and electrically connected to each end portion of the resistor. The back electrodes are typically formed by metal glaze containing Ag.

A chip resistor is mounted on a circuit board by solder material. FIG. 28 is a cross sectional view showing a conventional chip resistor A100 mounted on a circuit board 101. In FIG. 28, the chip resistor A100 is mounted on a wiring pattern 102 of the circuit board 101 by solder material 103. If there is a significant difference between thermal expansion of the circuit board 101 and thermal expansion of a substrate 1 of the chip resistor A100, in the case of applying a temperature cycle, stress resulting from the thermal expansion difference is applied on the solder material 103, causing a crack 104 on the solder material 103. Particularly, when the chip resistor A100 (substrate 1) is larger, the more stress is resulted from the thermal expansion difference, such that the possibility that a crack 104 occurs is higher. A large chip resistor A100 (3.2 mm×1.6 mm, for example) is used in automotive applications, and thus the crack 104 should be concerned.

PRIOR TECHNICAL LITERATURE

Patent Literatures

[Patent Literature 1] Japanese Patent Application Publication No. 2015-50234

BRIEF SUMMARY OF THE INVENTION

Problems to be Solved

In light of the above illustration, the present invention provide a chip resistor and a method for fabricating the same for alleviating stress resulting from a thermal expansion difference and suppressing generation of cracks.

Technical Means for Solving Problems

It is an aspect of the present invention to provide a chip resistor. The chip resistor includes a substrate having a carrying surface and a mounting surface facing away from each other; a pair of upper electrodes disposed at two ends of the carrying surface of the substrate; a resistor mounted on the carrying surface of the substrate, and between the pair of upper electrodes, and electrically connected to the pair of upper electrodes; a stress relaxation layer having flexibility and formed on the mounting surface of the substrate; a metal thin film layer formed on a surface of the stress relaxation layer opposite to the substrate and having a pair of regions spaced apart in a first direction; a pair of side electrodes for electrically connecting the pair of upper electrodes and the pair of regions of the metal thin film layer; and a plating layer covering the side electrode and the metal thin film layer.

In a preferred embodiment of the present invention, the stress relaxation layer includes silicone resin or epoxy resin.

In a preferred embodiment of the present invention, the stress relaxation layer includes conductive resin.

In a preferred embodiment of the present invention, the stress relaxation layer is formed on all of the mounting surface of the substrate.

In a preferred embodiment of the present invention, the stress relaxation layer comprises a pair of regions spaced apart from each other in the first direction and formed respectively at two ends of the mounting surface of the substrate.

In a preferred embodiment of the present invention, end surfaces of each of the regions of the stress relaxation layer, facing each other in the first direction, are exposed by each of the regions of the metal thin film layer, and each of the regions of the metal thin film layer covers a part of each of the regions of the stress relaxation layer.

In a preferred embodiment of the present invention, end surfaces of each of the regions of the stress relaxation layer, facing each other in the first direction, are covered by each of the regions of the metal thin film layer.

In a preferred embodiment of the present invention, the metal thin film layer includes Ni—Cr alloy.

In a preferred embodiment of the present invention, the metal thin film layer includes a sputtered layer.

In a preferred embodiment of the present invention, the side electrode includes a second sputtered layer formed on a side surface of the substrate between the carrying surface and the mounting surface of the substrate; wherein the sputtered layer and the second sputtered layer are integrally formed.

In a preferred embodiment of the present invention, the side electrode includes a portion disposed on a side surface of the substrate between the carrying surface and the mounting surface of the substrate; and a portion overlapping with the carrying surface and the mounting surface in a thickness direction of the substrate.

In a preferred embodiment of the present invention, the side electrode includes Ni—Cr alloy.

In a preferred embodiment of the present invention, the plating layer includes a Ni plating layer and a Sn plating layer.

In a preferred embodiment of the present invention, a thickness of the stress relaxation layer is 10-50 μm.

In a preferred embodiment of the present invention, the substrate is an electrical insulator.

In a preferred embodiment of the present invention, the substrate includes alumina.

In a preferred embodiment of the present invention, the resistor is of a serpentine shape as viewed from a top view.

In a preferred embodiment of the present invention, the resistor includes $RuO_2$ or Ag—Pd alloy.

In a preferred embodiment of the present invention, the resistor has a trimming groove penetrating in a thickness direction.

In a preferred embodiment of the present invention, the chip resistor further includes a protective film covering the resistor and a part of the upper electrode.

In a preferred embodiment of the present invention, the protective film has a lower protective film and an upper protective film.

In a preferred embodiment of the present invention, the lower protective film includes glass.

In a preferred embodiment of the present invention, the upper protective film includes epoxy resin.

It is an aspect of the present invention to provide a method of making a chip resistor. The method includes: preparing a sheet-like substrate with a carrying surface and a mounting surface facing away from each other, and forming a pair of upper electrodes spaced apart from one another on the carrying surface of the sheet-like substrate; mounting a resistor electrically connected to the upper electrodes in a region of the carrying surface of the sheet-like substrate sandwiched between the pair of upper electrodes; forming a stress relaxation layer having flexibility on the mounting surface; forming a metal thin film layer having a pair of regions on a surface of the stress relaxation layer opposite to the sheet-like substrate; dividing the sheet-like substrate into a plurality of strip-shaped substrates with short sides in a direction in which the pair of upper electrodes are separated; forming a pair of side electrodes for electrically connecting the pair of upper electrodes and the pair of regions of the metal thin film layer, on a side surface along two ends in a longitudinal direction of the strip-shaped substrate, the carrying surface, and the mounting surface; and forming a plating layer covering the side electrodes and the metal thin film layer.

In a preferred embodiment of the present invention, forming the metal thin film layer is by physical vapor deposition.

In a preferred embodiment of the present invention, the physical vapor deposition is sputtering.

In a preferred embodiment of the present invention, the resistor is mounted by printing, or physical vapor deposition and photolithography.

In a preferred embodiment of the present invention, the method further includes dividing the strip-shaped substrate into a plurality of pieces before forming the plating layer.

In a preferred embodiment of the present invention, the method further includes forming a trimming groove through the resistor.

In a preferred embodiment of the present invention, the method further includes forming a protective film covering the resistor and a portion of the upper electrode.

Effects of the Present Invention

In accordance with the present invention, the stress relaxation layer having flexibility is formed on the mounting surface of the substrate and between the metal thin film layer electrically connected to the resistor and the substrate. Accordingly, in the case of mounting on a circuit board, stress resulted from the thermal expansion difference between the substrate and the circuit board can be alleviated by deformation of the stress relaxation layer, so as to suppress generation of cracks.

In addition, since the metal thin film layer is formed between the stress relaxation layer and the plating layer, the direct contact area between the plating layer and the stress relaxation layer is small. Hence, even in the case that the stress relaxation layer includes resin, the plating layer is easily formed.

Other features and advantages of the present invention are more explicit based on the following descriptions and the accompanying drawings.

DETAILED DESCRIPTION

The manner in which the present invention is implemented (hereinafter referred to as "an embodiment") will be described with reference to the drawings.

The First Embodiment

Figure 1:
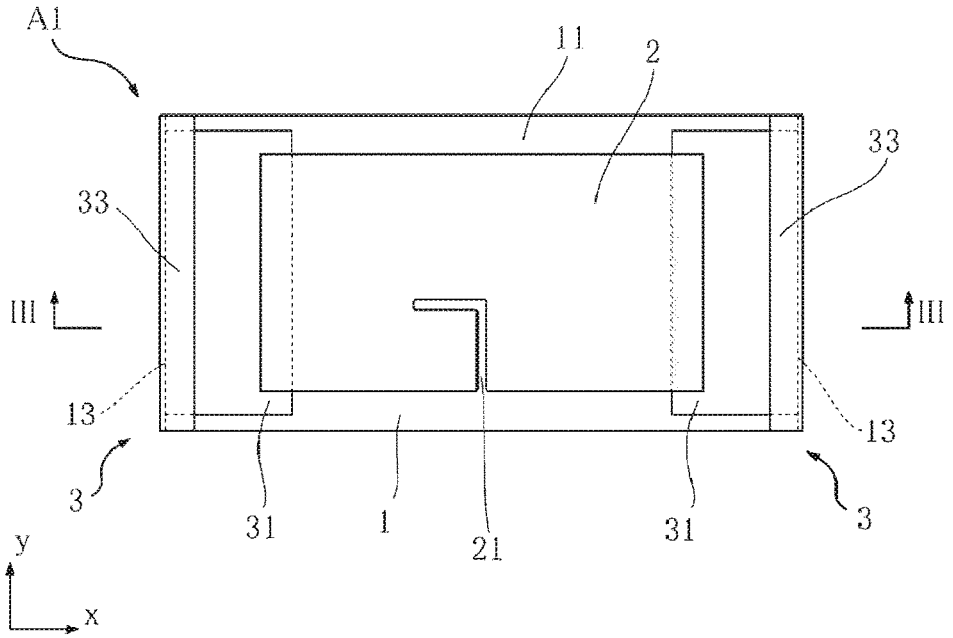
FIG. 1 is a top view showing a chip resistor in accordance with the first embodiment of the present invention.
Figure 2:
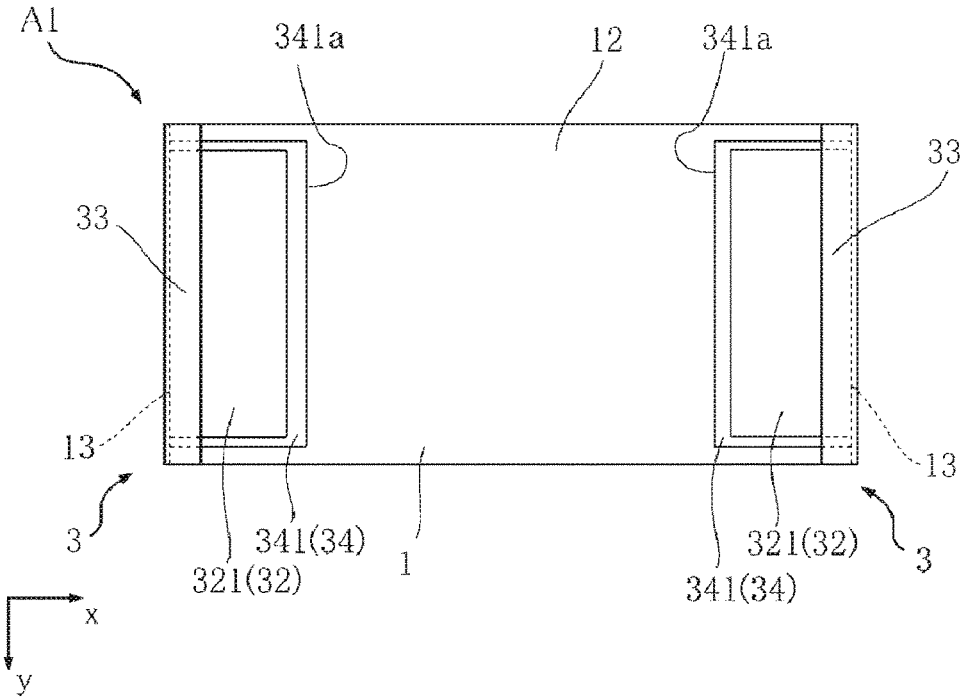
FIG. 2 is a bottom view showing the chip resistor in FIG. 1.
Figure 3A:
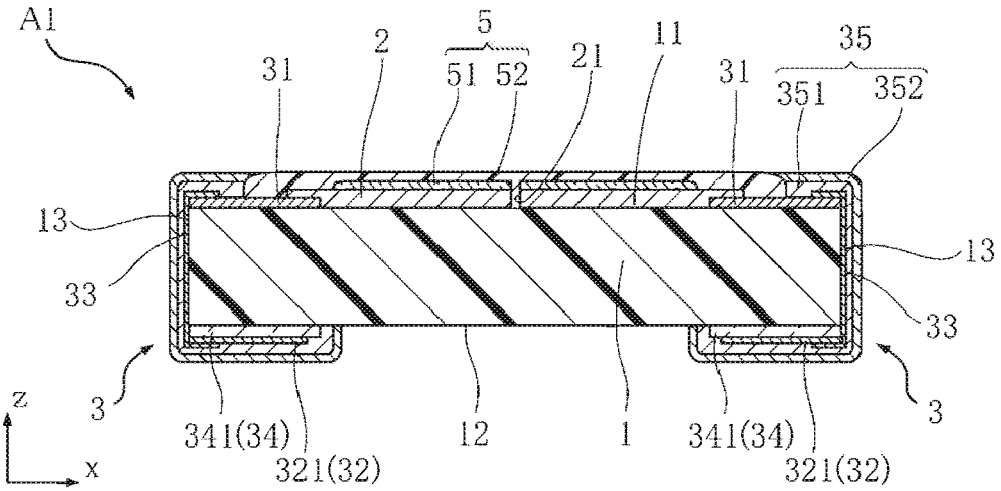
FIGS. 3(*a*) and 3(*b*) are cross sectional view and enlarged cross sectional view respectively showing a portion along line II-II in FIG. 1.
Figure 3B:
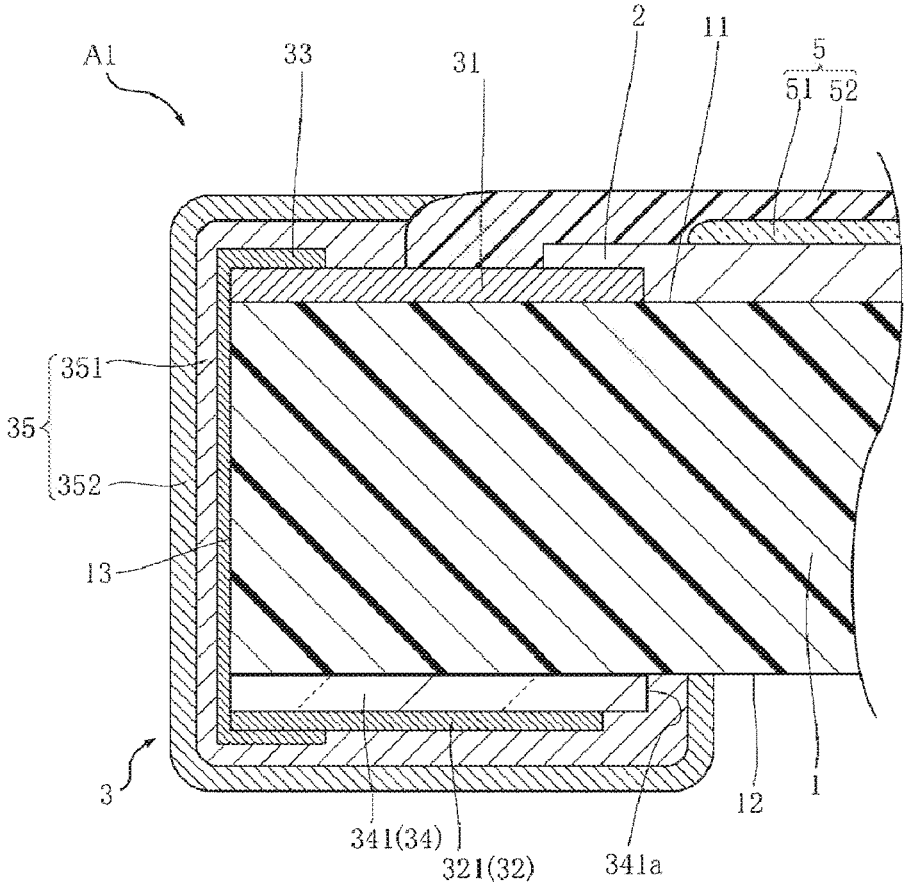

Referring to FIGS. 1-3, a chip resistor A1 in the first embodiment of the present invention is illustrated. FIG. 1 is a top view showing the chip resistor A1. FIG. 2 is a bottom view showing the chip resistor A1. FIG. 3(*a*) is a cross sectional view along line III-III in FIG. 1. FIG. 3(*b*) is an enlarged view showing a portion in FIG. 3(*a*). Additionally, for better understanding, a plating layer 35 and a protective film 5 are omitted in FIG. 1 and FIG. 2. Further, in these figures and in the following descriptions, the direction (the top view direction) along the thickness of the chip resistor A1 is set as a z direction, the direction along the long side of the chip resistor A1 is set as an x direction, and the direction along the short side of the chip resistor A1 is set as a y direction.

In these figures, the chip resistor A1 is a type of a chip resistor mounted on a surface of a circuit board in various electronic devices. In the present embodiment, the chip resistor A1 includes a substrate 1, a resistor 2, an electrode 3 and a protective film 5. In the present embodiment, the chip resistor A1 is of a rectangular shape as viewed from a top view. The chip resistor A1 in the present embodiment is a so-called thick film (metal glaze film) chip resistor.

As shown in FIGS. 1-3, the substrate 1 is used for carrying the resistor 2 and mounting the chip resistor A1 on a circuit board of various electronic devices. The substrate 1 is an electrical insulator. In the present embodiment, the substrate 1 includes alumina ($Al_2O_3$), for example. When the chip resistor A1 is used, in order to dissipate heat generated from the resistor 2 outside, the substrate 1 is preferably a material with high thermal conductivity. The substrate 1 includes a carrying surface 11, a mounting surface 12 and a side surface 13. In the present embodiment, the substrate 1 is of a rectangular shape as viewed from a top view, and the size of the substrate in the thickness direction (z direction) is about 100-500 μm.

As shown in FIG. 3(*a*) or FIG. 3(*b*), the carrying surface 11 is an upper surface of the substrate 1, and is the surface for carrying the resistor 2. The mounting surface 12 is a lower surface of the substrate 1 as shown in FIG. 3(*a*) or FIG. 3(*b*), and is the surface for the chip resistor A1 to be mounted on a circuit board of various electronic devices. The carrying surface 11 and the mounting surface 12 are facing away from each other. As shown in FIGS. 1-3, the side surfaces 13 are a pair of surfaces orthogonal to the carrying surface 11 and the mounting surface 12, and facing to the long side direction (x direction) of the substrate 1. The side surfaces 13 are between the carrying surface 11 and the mounting surface 12.

The resistor 2 has functions such as limiting current or detecting current. In the present embodiment, the resistor 2 is of a band shape along the x direction as viewed from a top view. The resistor 2 includes a resistance material such $RuO_2$ or Ag—Pd alloy, and is formed by printing and baking a paste material having the resistance material. In addition, the material of the resistor 2 is not limited. Further, in the present embodiment, the resistor 2 is of a band shape as viewed from a top view, but can be of any shape such as a serpentine shape. The resistor 2 has a trimming groove 21.

As shown in FIG. 1 and FIG. 3(*a*), the resistor 2 has a trimming groove 21 penetrating through the thickness direction (z direction). The trimming groove 21 is formed for adjusting a resistance value of the resistor 2 to a desired value. In the present embodiment, the trimming groove 21 is of an L shape as viewed from a top view, and formed at the resistor 2. Additionally, the shape and the number of the trimming groove 21 are not limited.

As shown in FIGS. 1-3, electrodes 3 are a pair of components spaced apart from each other, electrically connected to the resistor 2, and used for connecting the chip resistor A1 to wiring patterns of a circuit board of various electronic devices. The electrodes 3 are arranged in the x direction at two sides sandwiching the resistor 2. In the present embodiment, the electrodes 3 have upper electrodes 31, metal thin film layers 32, side electrodes 33, stress relaxation layers 34 and plating layers 35.

As shown in FIG. 1 and FIG. 3(*a*) or 3(*b*), the upper electrodes 31 are a pair of electrodes spaced apart from each other and disposed at two ends of the carrying surface 11 of the substrate 1. The upper electrode 31 is of a rectangular shape as viewed from a top view. Further, a portion of the upper electrode 31 is sandwiched between the carrying surface 11 and the resistor 2. Therefore, the resistor 2 is electrically connected to the upper electrode 31. In addition, a portion of the resistor 2 can be sandwiched between the upper electrode 31 and the carrying surface 11. The upper electrode 31 is made of metal glaze including Ag, for example, and can be formed by print and baking a paste material having Ag. Moreover, the material and shape of the upper electrode 31 are not limited.

As shown in FIG. 2 and FIG. 3(*a*) or 3(*b*), the stress relaxation layer 34 includes a pair of regions 341 spaced apart from each other and formed respectively at two ends of the mounting surface 12 of the substrate 1. The shape of the regions 341 of the stress relaxation layer 34 as viewed from a top view are about the same as that of the upper electrode 31. Further, the shapes of the regions 341 of the stress relaxation layer 34 are not limited. The stress relaxation layer 34 includes a resin having flexibility such as epoxy resin or silicone resin, and can be formed by printing and curing the resin paste. In the present embodiment, the stress relaxation layer 34 can be insulating resin paste, or can be conductive resin paste having Ag, for example. In other words, the stress relaxation layer 34 is made of a flexible material, whether it is insulating or conductive. The size of the stress relaxation layer 34 in the thickness direction (z direction) is about 10-50 μm. If the size is too small, the flexibility of the stress relaxation layer 34 is impaired, such that it is difficult to alleviate stress resulted from the thermal expansion difference. On the other hand, if the size is too large, the size of the chip resistor A1 in the thickness direction is increased. Further, in the step of forming the stress relaxation layer 34, the time for curing becomes longer, such that the manufacturing efficiency is reduced. The size can be properly designed according to the thermal stress level resulted from the material difference between the substrate 1 and the circuit board 101 to be mounted or the size of the substrate 1, for example.

As shown in FIG. 2 and FIG. 3(*a*) or 3(*b*), the metal thin film layer 32 includes a pair of regions 321 respectively disposed on a surface of each stress relaxation layer 34 opposite to the substrate 1. The regions 321 of the metal thin film layer 32 have shapes as viewed from a top view about the same as the shapes of the regions 341, and are smaller than the regions 341 (referring to FIG. 2). In addition, the shapes of the regions 321 of the metal thin film layer 32 are not limited. The metal thin film layer 32 can be formed by forming Ni—Cr alloy film by physical vapor deposition (PVD) based on a sputtering method or the like, for example. The size of the metal thin film layer 32 in the thickness direction (z direction) is about dozens to hundreds nm. Further, the material of the metal thin film layer 32 is not limited as long as it is a conductive metal containing no resin.

Each of the regions 321 of the metal thin film layer 32 functions as an electrode on the mounting surface 12 side and has a function of reducing the area where the plating layer 35 is in direct contact with the stress relaxation layer 34. Since the stress relaxation layer 34 includes resin, it is difficult to form the plating layer 35 directly on the stress relaxation layer 34, and even if the plating layer 35 is formed on the stress relaxation layer 34, it is easy to peel off. In order to avoid this situation, the metal thin film layer 32 is formed on a surface of the stress relaxation layer 34 opposite to the substrate 1, reducing the area where the plating layer 35 is in direct contact with the stress relaxation layer 34. Since the metal thin film layer 32 is formed by a sputtering method or the like and is formed of a metal containing no resin, the plating layer 35 is easily formed.

In addition, in the present embodiment, end surfaces 341*a* of each of the regions 341 of the stress relaxation layer 34, facing each other, and the vicinity thereof are exposed by each of the regions 321 of the metal thin film layer 32 (referring to FIG. 3(*b*)), but is not limited thereto. Further, in the present embodiment, each end surface connected to the end surfaces 341 and the vicinity thereof are also exposed by each of the regions 321 of the metal thin film layer 32 (referring to FIG. 2), but is not limited thereto. The regions 321 of the metal thin film layer 32 can be formed between the stress relaxation layer 34 and the plating layer 35 so that the area where the stress relaxation layer 34 is in contact with the plating layer 35 becomes small.

As shown in FIG. 1 to FIG. 3(*a*) or FIG. 3(*b*), the side electrodes 33 are a pair of electrodes respectively disposed on side surfaces 13 of the substrate 1 and spaced apart from each other. The side electrodes 33 not only covers the side surfaces 13, but also the upper electrode 31 and a portion of the region 321 of the metal thin film layer 32. In other words, the side electrode 33 has a portion disposed on the side surface 13 and a portion overlapping the carrying surface 11 and the mounting surface 12 of the substrate 1 as viewed in the thickness direction of the substrate 1. By the side electrode 33, the upper electrode 31 and the region 321 of the metal thin film layer 32 are electrically connected to each other. Therefore, by the upper electrode 31 and the side electrode 33, the resistor 2 is electrically connected to the region 321 of the metal thin film layer 32. In the present embodiment, the side electrode 33 is made of metal glaze containing Ag, for example, and can be formed by printing and baking paste containing Ag. In addition, the material and the shape of the side electrode 33 are not limited, and also the method for forming the side electrode 33 is not limited.

As shown in FIG. 3(*a*) or FIG. 3(*b*), the plating layer 35 is a pair of components spaced apart from each other and covering a portion of the upper electrode 31, the region 321 of the metal thin film layer 32, and the side electrode 33. The plating layer 35 has an inner plating layer 351 and an outer plating layer 352. The inner plating layer 351 covers a portion of the upper electrode 31, the region 321 of the metal thin film layer 32 and the side electrode 33, and has the function of protecting the upper electrode 31, the region 321 of the metal thin film layer 32 and the side electrode 33 from heat or impact. In the present embodiment, the inner plating layer 351 is made of a Ni plating layer, for example. The inner plating layer 351 is covered by the outer plating layer 352. In the present embodiment, the outer plating layer is made of a Sn plating layer, for example. The chip resistor A1 is connected to the wiring patterns of a circuit board of various electronic devices by attaching solder to the outer plating layer 352 and integrating the outer plating layer 352 with the solder. In the present embodiment, the inner plating layer 351 is made by a Ni plating layer, such that it is difficult to adhere the solder directly to the inner plating layer 351. Therefore, it is necessary to form an outer plating layer 352 made of a Sn plating layer.

As shown in FIG. 3(*a*) or FIG. 3(*b*), the protective film 5 is a component that covers the resistor 2 and functions to protect the resistor 2 from external damage. The protective film 5 has a lower protective film 51 and an upper protective film 52. The lower protective film 51 covers a surface of the resistor 2 (an upper surface of the resistor 2 shown in FIG. 3(*a*) or FIG. 3(*b*)). The lower protective film 51 includes glass, for example, and is formed by printing and baking paste containing glass. The upper protective film 52 covers a portion of the substrate 1, the resistor 2, the lower protective film 51 and a portion of the upper electrode 31. The upper protective film 52 includes epoxy resin, for example, and can be formed by printing and curing paste containing epoxy resin. Further, the material and shape of the lower protective film 51 and the upper protective film 52 are not limited.

Subsequently, referring to FIG. 4 to FIG. 15(*b*), a method for making a chip resistor A1 is illustrated.

Figure 12:
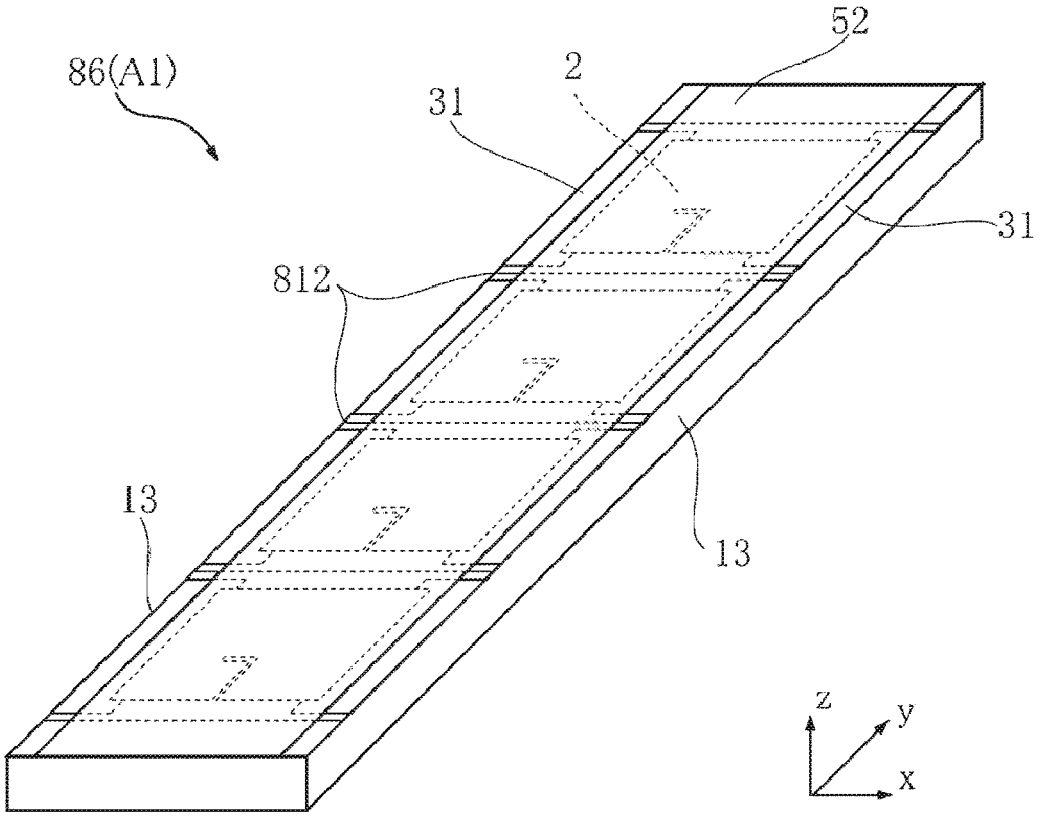
FIG. 12 is a schematic view showing a step of a method for making the chip resistor in FIG. 1.
Figure 13:
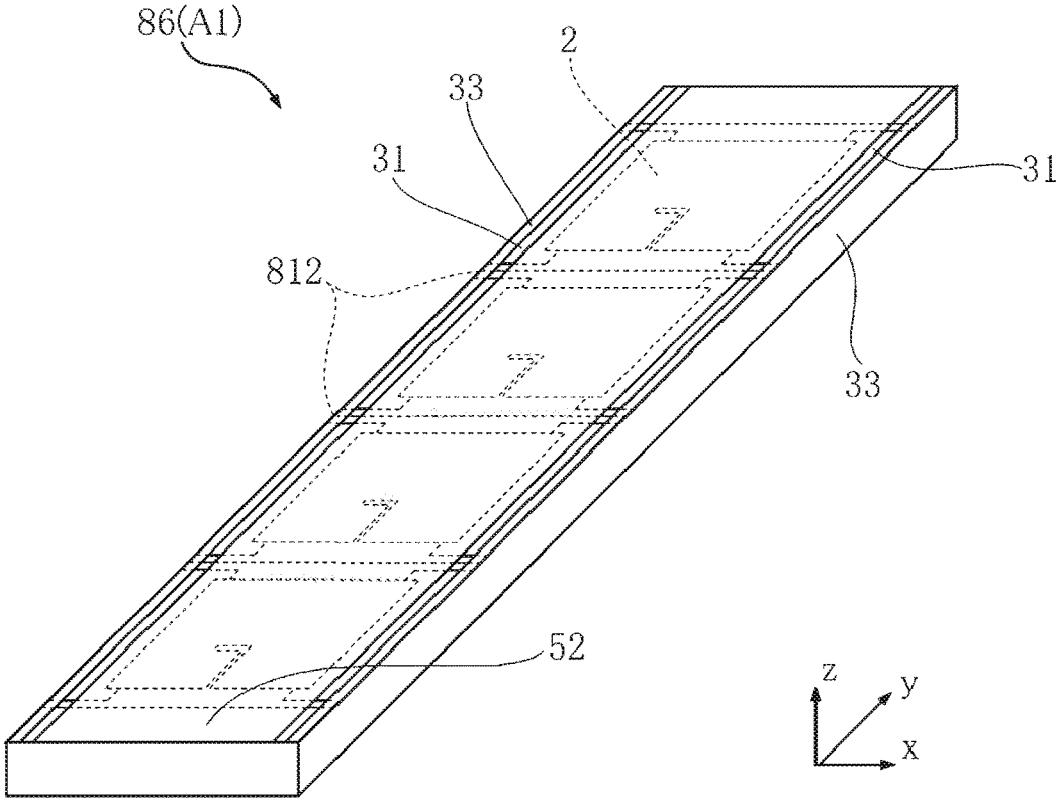
FIG. 13 is a schematic view showing a step of a method for making the chip resistor in FIG. 1.
Figure 14A:
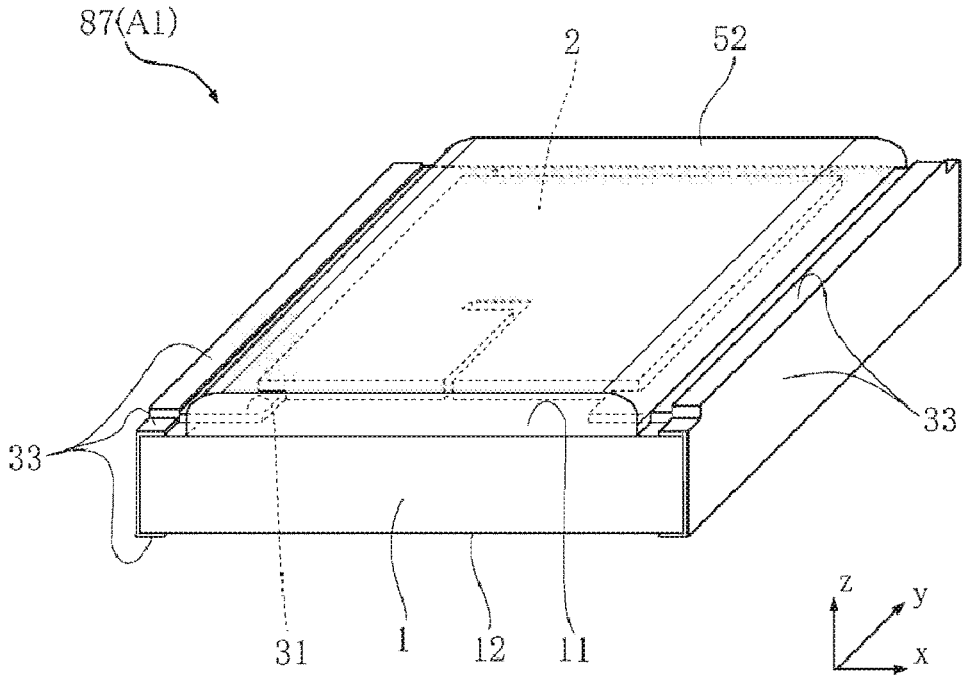
FIGS. 14(*a*) and 14(*b*) are schematic view and front view respectively showing a step of a method for making the chip resistor in FIG. 1.
Figure 14B:
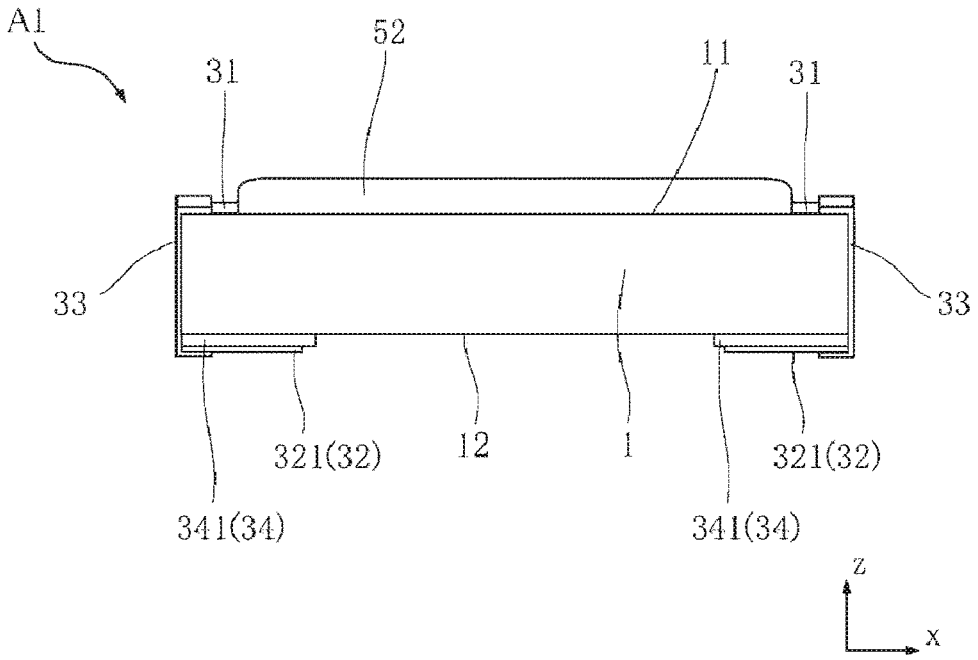

FIG. 4 to FIG. 9 are top views showing steps of the method for making a chip resistor A1. FIG. 10 is a bottom view showing a step of the method for making a chip resistor A1. FIG. 11 is a front view showing a step of the method for making a chip resistor A1. FIG. 12 and FIG. 13 are schematic views showing steps of the method for making a chip resistor A1. FIGS. 14(*a*), 14(*b*) and FIGS. 15(*a*), 15(*b*) are schematic views and front views showing steps of the method for making a chip resistor A1. Further, for better understanding, the lower protective film 51 of the protective film 5 is omitted in FIG. 8 to FIG. 15(*b*). In addition, for better understanding, the thicknesses of the resistor 2, the upper electrode 31, the side electrode 33 and the upper protective film 52 are ignored in FIG. 12 and FIG. 13.

Figure 4:
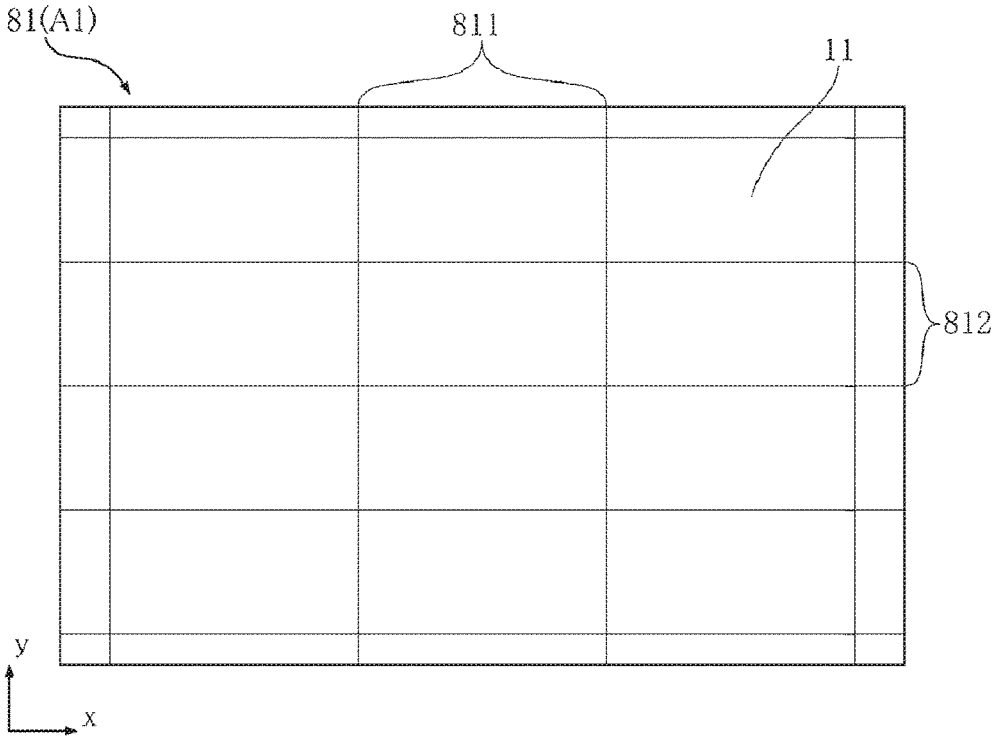
FIG. 4 is a top view showing a step of a method for making the chip resistor in FIG. 1.

First, as shown in FIG. 4, a sheet-like substrate 81 containing alumina is prepared. The sheet-like substrate 81 includes a carrying surface 11 and a mounting surface 12. The carrying surface 11 and the mounting surface 12 are facing away from each other. FIG. 4 shows the carrying surface 11 of the sheet-like substrate 81. On the carrying surface 11, a plurality of primary division grooves 811 are formed in the longitudinal direction (y direction) shown in FIG. 4 and a plurality of secondary division grooves 812 are formed in the lateral direction (x direction) shown in FIG. 4, in the form of a grid. The primary division grooves 811 and the secondary division grooves 812 are formed in the same number on the mounting surface 12 opposite to the carrying surface 11 (not shown). The positions of the primary division grooves 811 and the secondary division grooves 812 as viewed from a top view are the same on the carrying surface 11 and the mounting surface 12. The block formed by the primary division grooves 811 and the secondary division grooves 812 is corresponding to a region of the substrate 1 of the chip resistor A1.

Figure 5:
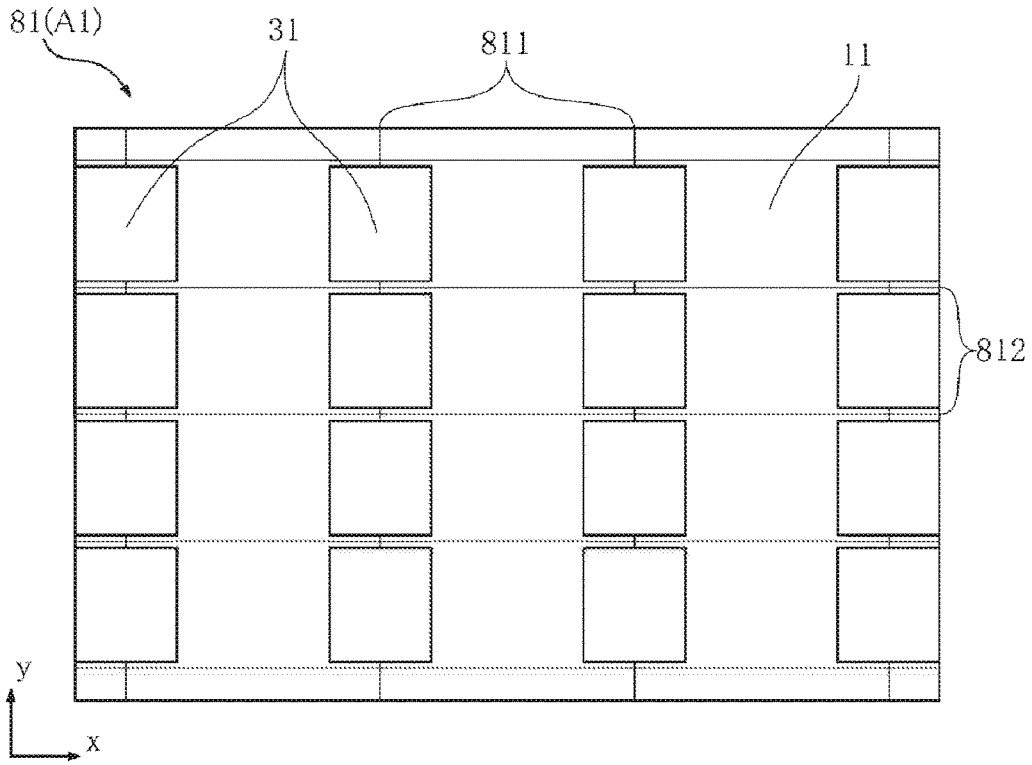
FIG. 5 is a top view showing a step of a method for making the chip resistor in FIG. 1.

Subsequently, as shown in FIG. 5, on the carrying surface 11 of the sheet-like substrate 81, the upper electrode 31 is formed so as to cross the primary division groove 811 of the sheet-like substrate 81. In the present embodiment, the upper electrode 31 is formed by printing paste containing Ag and glass frit on the carrying surface 11 by silk screen, and baking in a baking furnace. By this step, a pair of upper electrodes 31 spaced apart from each other is formed on the carrying surface 11.

Figure 6:
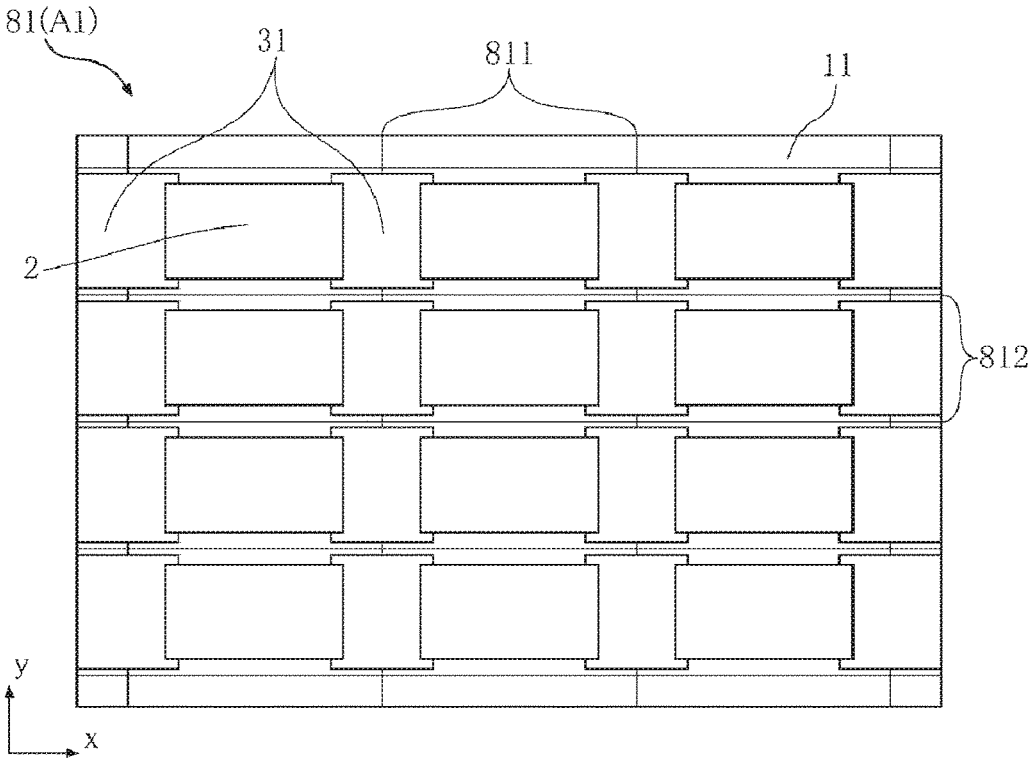
FIG. 6 is a top view showing a step of a method for making the chip resistor in FIG. 1.

Subsequently, as shown in FIG. 6, the resistor 2 which is electrically connected to the upper electrode 31 is disposed on the carrying surface 11 of the sheet-like substrate 81 in the area sandwiched by the upper electrodes 31 in the x-direction. In the present embodiment, the resistor 2 is disposed by printing paste containing metal such as $RuO_2$ or Ag—Pd alloy and glass frit by silk screen, and baking in a baking furnace. In addition, the resistor 2 can be disposed on the carrying surface 11 of the sheet-like substrate 81 first, and then the upper electrode 31 electrically connected to each resistor 2 is formed in the region sandwiched by each resistor 2.

Figure 7:
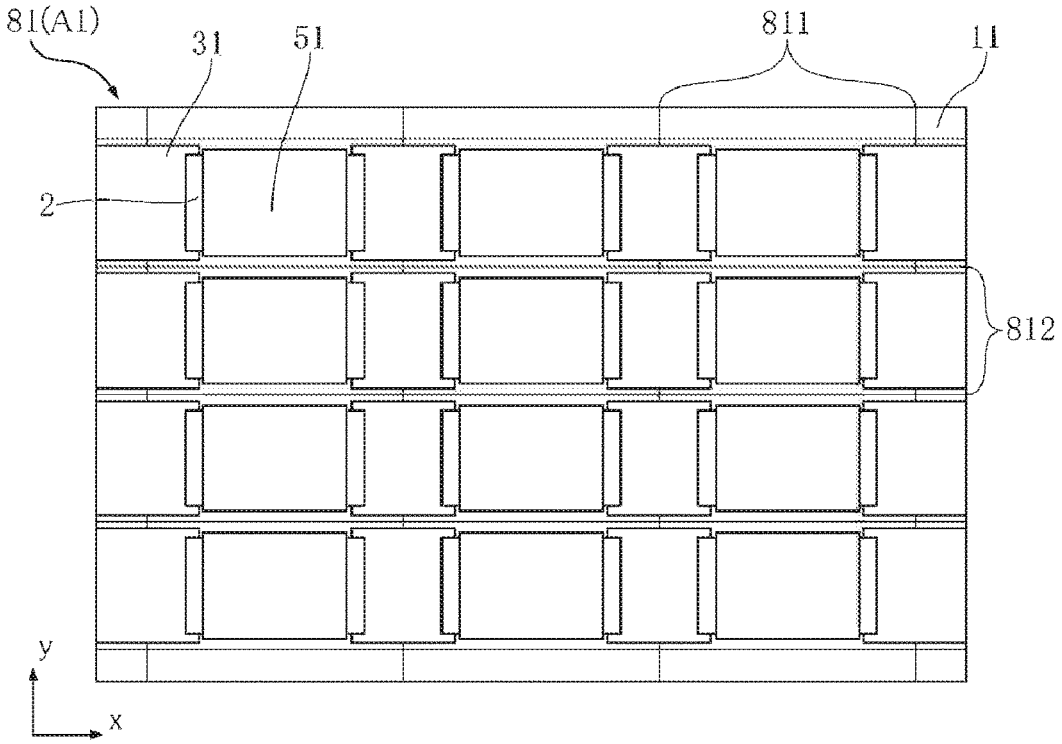
FIG. 7 is a top view showing a step of a method for making the chip resistor in FIG. 1.

Subsequently, as shown in FIG. 7, a lower protective film 51 covering a surface of the resistor 2 is formed. In the present embodiment, the lower protective film 51 is formed by printing a paste containing glass by silk screen and baking in a baking furnace. Since in a subsequent step of the subsequent step, that is, in the step of forming the trimming groove 21 in the resistor 2, the groove is formed by using laser, there is thermal impact on the resistor 2, and fine particles of the resistor 2 are generated. Hence, the lower protective film 51 functions to alleviate the thermal impact, and to avoid the fine particles from adhering to the resistor and changing resistance value of the resistor.

Figure 8:
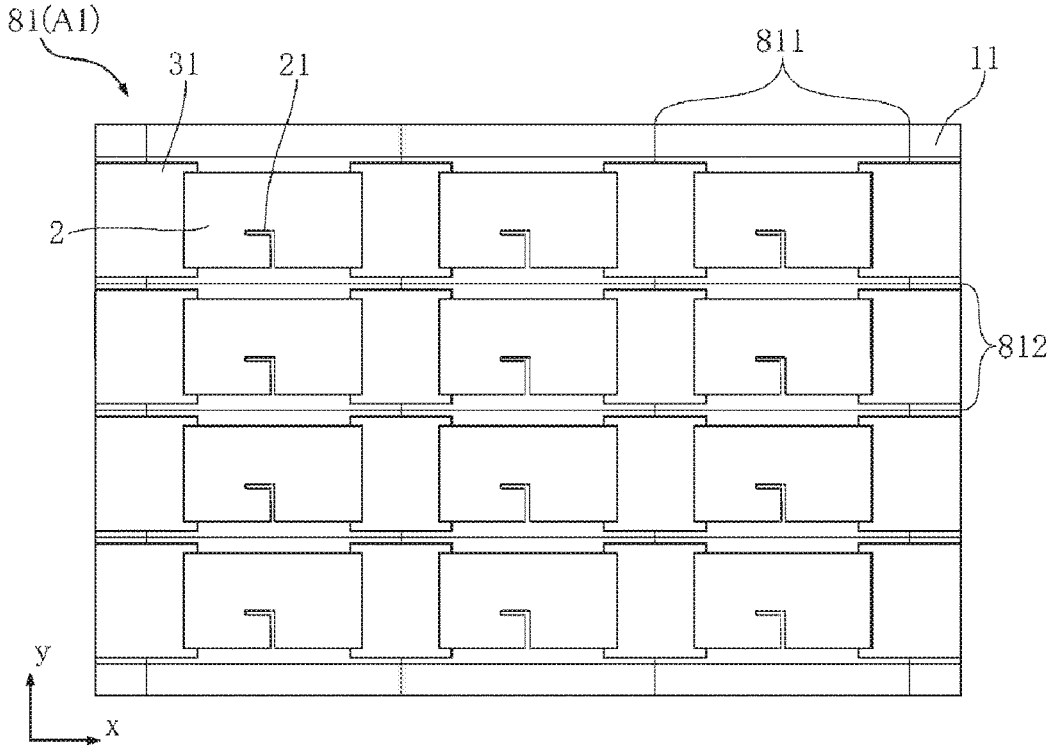
FIG. 8 is a top view showing a step of a method for making the chip resistor in FIG. 1.

Subsequently, as shown in FIG. 8, a trimming groove 21 penetrating the resistor 2 is formed on the resistor 2. The trimming groove 21 can be formed by using a laser trimming device (not shown). The trimming groove 21 is formed in the following sequence. First, the trimming groove 21 is formed from one side surface of the resistor 2 along the longitudinal direction (x direction) toward the other side surface of the resistor 2, so as to be orthogonal to the direction of the current flowing in the resistor 2. Then, after the resistance value of the resistor 2 rises to a value close to the desired value of the chip resistor A1, the trimming groove 21 is formed by changing the orientation by 90° to a direction parallel to the current flowing direction (x direction) in the resistor 2. When the resistance value of the resistor 2 becomes the desired value of the chip resistor A1, the formation of the trimming groove 21 is ended. By this step, the trimming groove 21 is formed on the resistor 2 and is of an L shape as viewed from a top view. In addition, the trimming groove 21 is formed in the state that a resistance value measuring probe (not shown) is brought into contact with both ends of the resistor 2 in the longitudinal direction (x direction).

Figure 9:
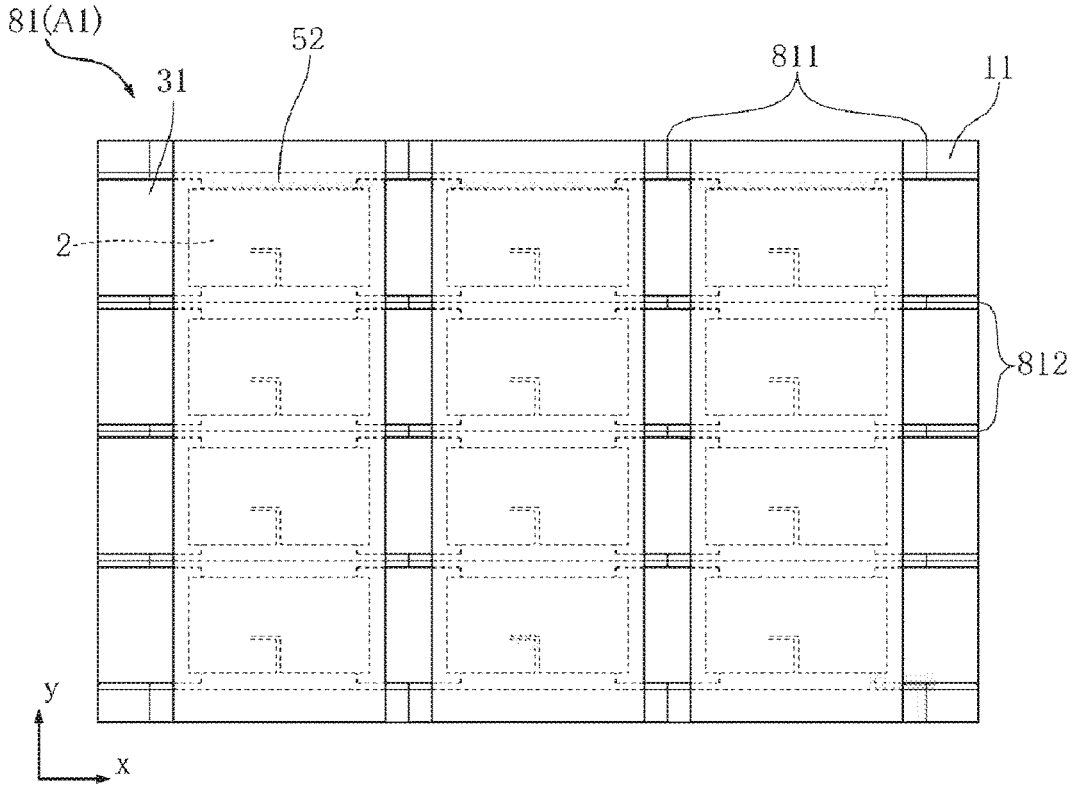
FIG. 9 is a top view showing a step of a method for making the chip resistor in FIG. 1.
Figure 10:
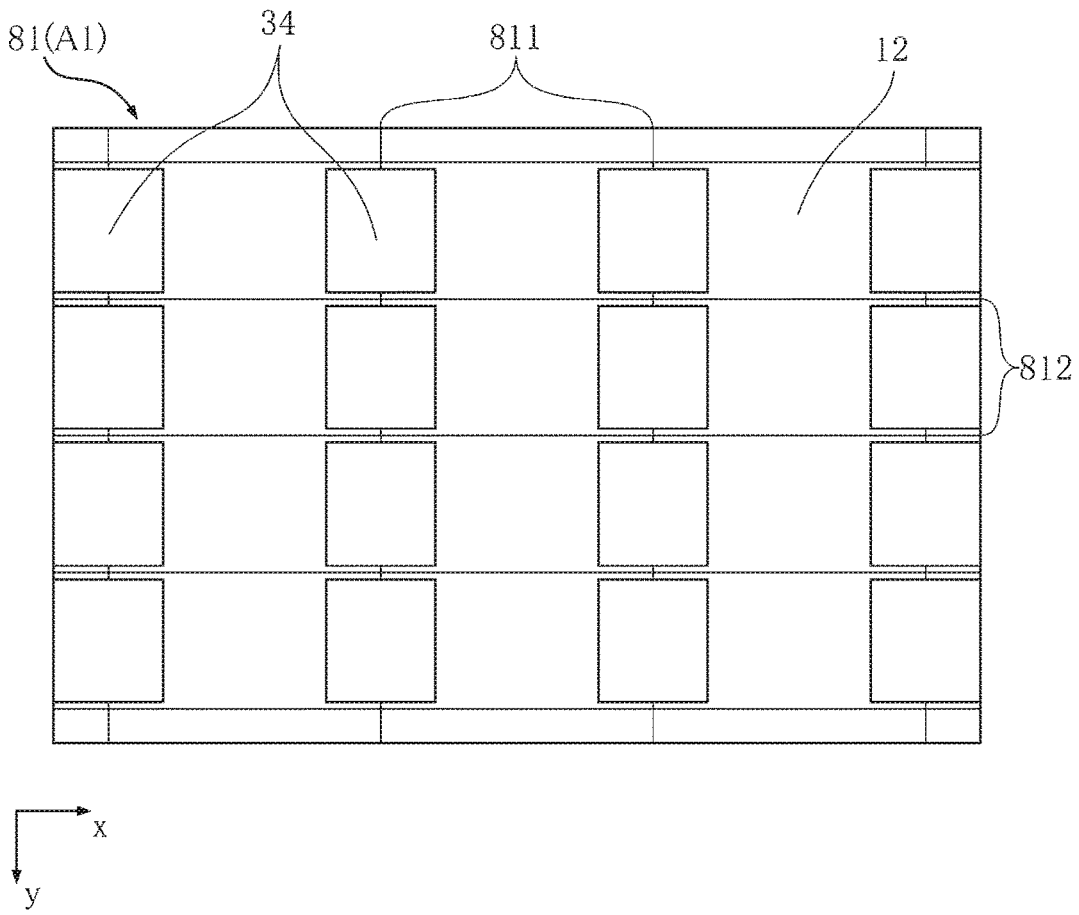
FIG. 10 is a bottom view showing a step of a method for making the chip resistor in FIG. 1.
Figure 11A:
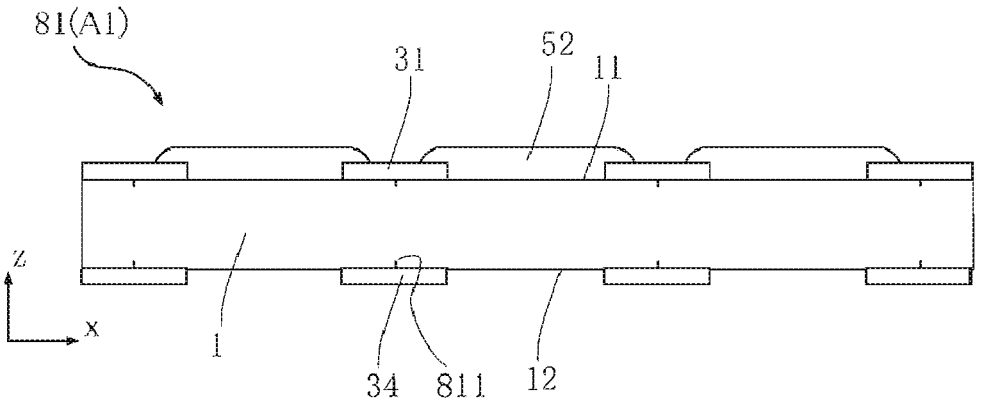
FIGS. 11(*a*)-11(*d*) are front views showing a step of a method for making the chip resistor in FIG. 1.
Figure 11B:
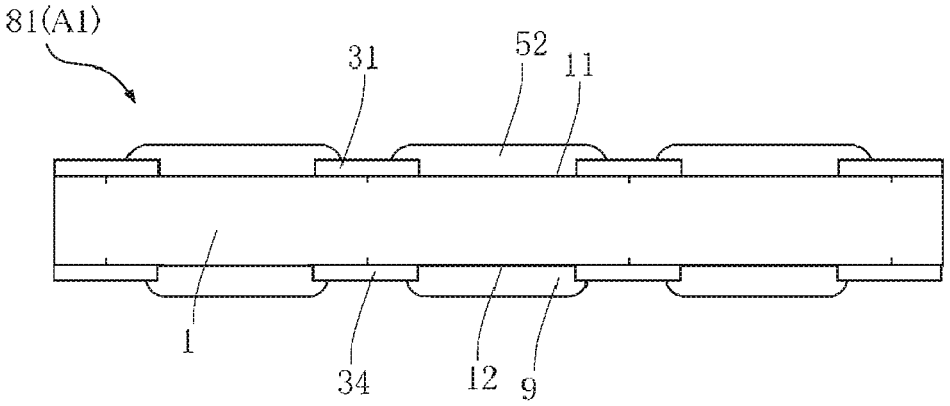
Figure 11C:
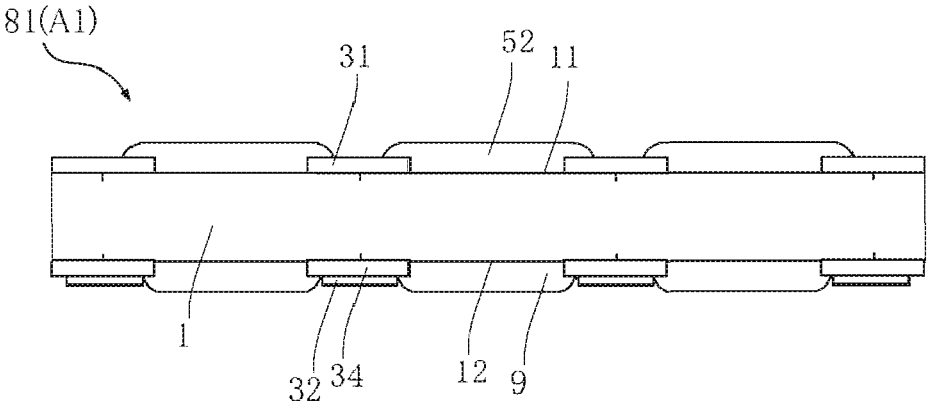
Figure 11D:
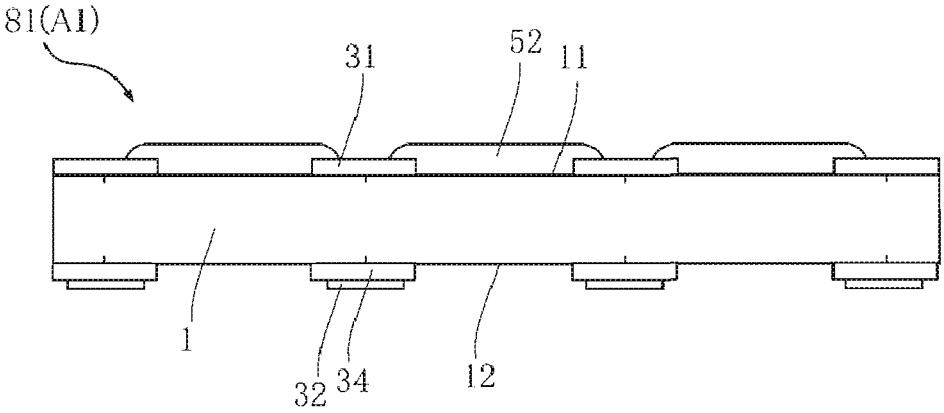

Subsequently, as shown in FIG. 9, on the carrying surface 11 of the sheet-like substrate 81, an upper protective film 52 is formed. At this time, in addition to the resistor 2, a part of each of the upper electrode 31 and the substrate 1 is also covered by the upper protective film 52. In the present embodiment, the upper protective film 52 is formed as a plurality of belt shapes extending along the primary division grooves 811 of the sheet-like substrate 81 so as to cross the secondary division grooves 812 of the sheet-like substrate 81. Further, in the present embodiment, the upper protective film 52 is formed by printing paste containing epoxy resin by silk screen, and curing the paste. In addition, the upper protective film 52 can also be formed so as to be separated for each resistor 2 in the same manner as the lower protective film 51 of the protective film 5 shown in FIG. 7.

Subsequently, as shown in FIG. 10, on the mounting surface 12 of the sheet-like substrate 81, the stress relaxation layer 34 is formed to cross the primary division grooves 811. The stress relaxation layer 34 and the upper electrode 31 have about the same positions and sizes as viewed from a top view. In the present embodiment, the stress relaxation layer 34 is formed on the mounting surface 12 by printing paste containing epoxy resin or silicone resin by silk screen, and curing the paste. By this step, the stress relaxation layer 34 is formed on the mounting surface 12 as a pair of regions 341 which are spaced apart from each other.

Subsequently, as shown in FIG. 11, on the mounting surface 12 of the sheet-like substrate 81, a metal thin film layer 32 is formed. FIG. 11(*a*) shows a front view of the state shown in FIG. 10, that is, the state in which the stress relaxation layer 34 is formed on the mounting surface 12 of the sheet-like substrate 81.

Subsequently, as shown in FIG. 11(*b*), on the mounting surface 12 of the sheet-like substrate 81, a masking film 9 is formed. The masking film 9 is formed in such a manner that an opening is disposed for exposing vicinity of the center of the surface of the stress relaxation layer 34 (hereinafter referred to as "surface") opposite to the substrate 1 (other than end portions of the surface). In the present embodiment, the masking film 9 is formed on the mounting surface 12 by printing paste containing calcium carbonate by silk screen and curing the paste.

Subsequently, as shown in FIG. 11(*c*), on the mounting surface 12 of the sheet-like substrate 81, a metal thin film layer 32 is formed. The metal thin film layer 32 is formed by forming a Ni—Cr alloy film, for example, by physical vapor deposition such as sputtering. The metal thin film layer 32 is formed only in a region where the masking film 9 is not formed. Therefore, the metal thin film layer 32 is formed only near the center of the surface of each stress relaxation layer 34.

Subsequently, as shown in FIG. 11(*d*), the masking film 9 is removed. By this step, the metal thin film layer 32 is formed on the surface of the stress relaxation layer 34.

Subsequently, as shown in FIG. 12, the sheet-like substrate 81 is cut at the primary division grooves 811 and divided into a plurality of strip-shaped substrates 86. At this time, side surfaces 13 are formed on two sides of the strip-shaped substrate 86 along the longitudinal direction (y-direction) of the strip-shaped substrate 86.

Subsequently, as shown in FIG. 13, side electrodes 33 are formed on the side surface 13 along the longitudinal direction (y-direction) of the strip-shaped substrate 86, and a part of each of the carrying surface 11 and the mounting surface 12. In the present embodiment, the side electrodes 33 are formed by printing paste containing Ag and glass frit and baking in a baking furnace. In addition, the side electrodes 33 can be formed by plating or physical vapor deposition based on sputtering or the like. The side surface 13 and the upper electrode 31 and a portion of the surface of the region 321 of the metal thin film layer 32 disposed orthogonally with the side surface 13 are integrally covered with the side electrode 33 when the side electrode 33 is formed (the region 321 is omitted in the figure). At this time, the side electrode 33 is in contact with end portions of the upper electrode 31, the stress relaxation layer 34 and the metal thin film layer 32 along the side surface 13. By this step, the upper electrode 31 and the region 321 of the metal thin film layer 32 are electrically connected to each other through the side electrode 33.

Subsequently, as shown in FIG. 14(*a*) or FIG. 14(*b*), the strip-shaped substrate is cut at the secondary division grooves 812 of the strip-shaped substrate 86 and is divided into a plurality of pieces 87. FIG. 14(*a*) is a schematic view, and FIG. 14(*b*) is a front view. At this time, the shape of the side electrode 33 is a ⊐-shape in which the substrate 1 is sandwiched. Further, side electrodes 33 are formed on a portion of the carrying substrate 11 and a portion of the mounting substrate 12 of the substrate 1, the portion of the carrying surface 11 and the mounting surface 12 of the substrate 1 being located at two ends sandwiching the portion of the side electrode 33 formed on a part of the respective surface of the upper electrode 31 and the metal thin film layer 32.

Figure 15A:
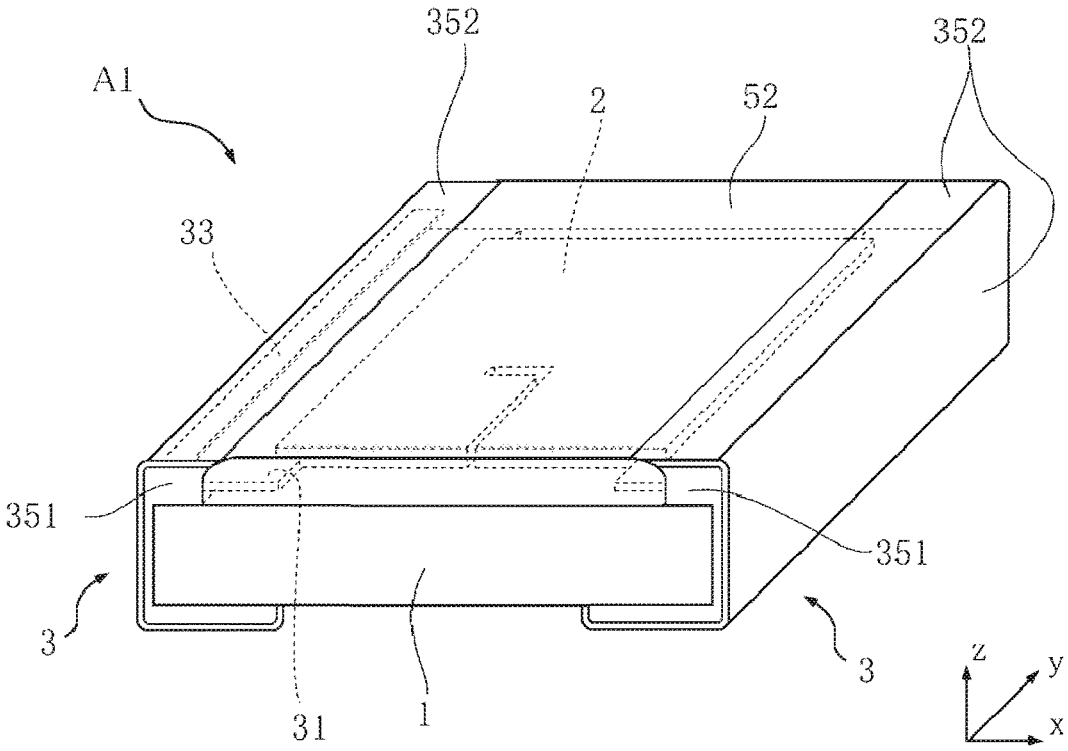
FIGS. 15(*a*) and 15(*b*) are schematic view and front view respectively showing a step of a method for making the chip resistor in FIG. 1.
Figure 15B:
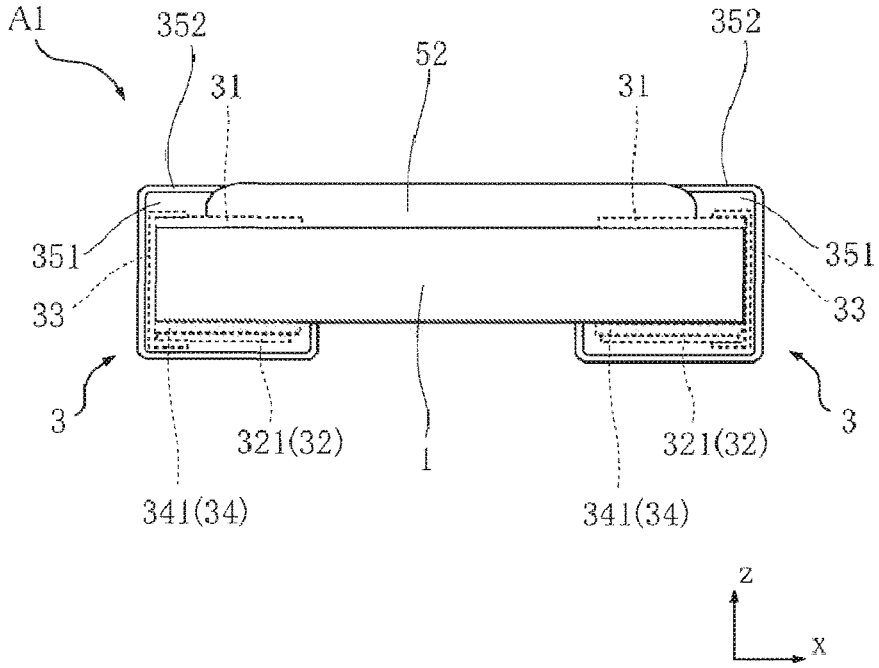

Subsequently, as shown in FIG. 15(*a*) or FIG. 15(*b*), a plating layer 35 (an inner plating layer 351 and an outer plating layer 352) is formed. FIG. 15(*a*) is a schematic view, and FIG. 15(*b*) is a front view. In addition, in FIG. 15(*b*), the upper electrode 31, the region 321 of the metal thin film layer 32, the side electrode 33 and the region 341 of the stress relaxation layer 34 are represented by dotted lines. Specifically, first, in the piece 87, the inner plating layer 351 covering the region 321 of the metal thin film layer 32, the side electrode 33 and the upper electrode 31 is formed. Then, the outer plating layer 352 covering the inner plating layer 351 is formed. In the present embodiment, the inner plating layer 351 is formed by Ni plating, and the outer plating layer 352 can be formed by Sn plating. By this step, a pair of electrodes 3 electrically connected to the resistor 2 is formed. The chip resistor A1 is manufactured by the above steps.

Then, the effect of the chip resistor A1 is illustrated.

Figure 16:
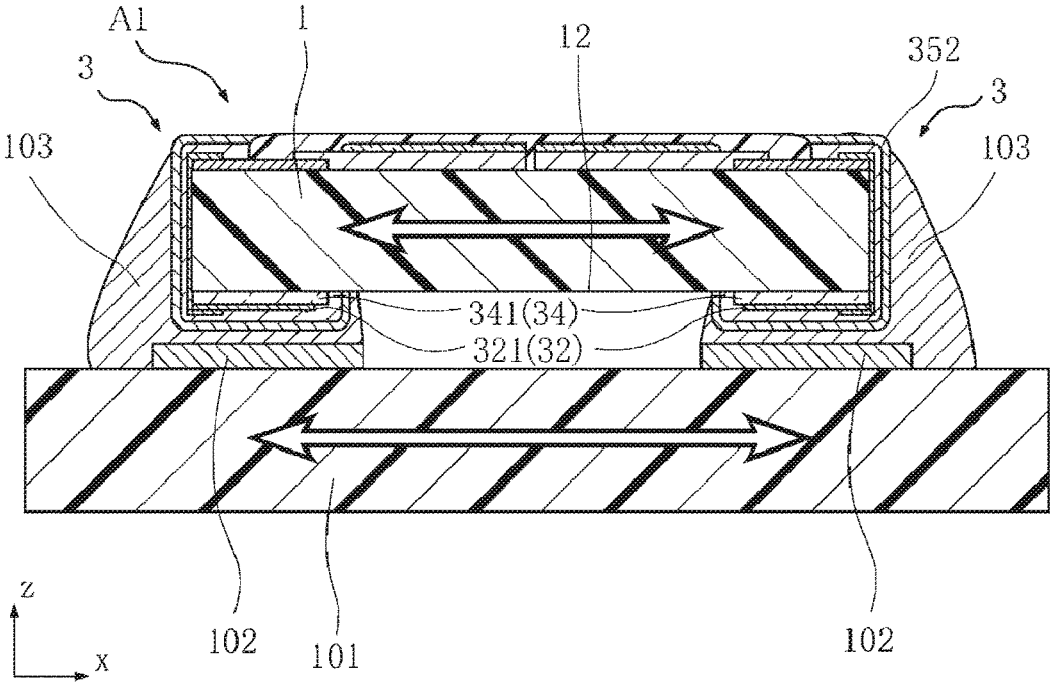
FIG. 16 is a cross sectional view showing the status that the chip resistor in FIG. 1 is mounted on a circuit board.

FIG. 16 is a cross sectional view showing the chip resistor A1 mounted on a circuit board. In FIG. 16, the chip resistor A1 is mounted on the circuit board 101 by directing the mounting surface 12 of the substrate 1 toward the circuit board 101 side and connecting the pair of electrodes 3 formed at both ends to a wiring pattern 102 with solder 103. The solder 103 and the outer plating layer 352 are integrally formed.

If the difference between the thermal expansion of the circuit board 101 and the thermal expansion of the substrate 1 of the chip resistor A100 is large, the stress resulted from the thermal expansion difference is applied to the solder 103 when a temperature cycle is applied. However, according to the present embodiment, the region 341 of the stress relaxation layer 34 with flexibility is formed between the region 321 of the metal thin film layer 32 and the substrate 1, such that the stress resulted from the thermal expansion difference can be alleviated by deformation of the region 341 of the stress relaxation layer 34. Hence, the generation of cracks can be suppressed.

Additionally, according to the present embodiment, the metal thin film layer 32 is formed between the stress relaxation layer 34 and the plating layer 35. As a result, the direct contact area between the plating layer 35 and the stress relaxation layer 34 including resin becomes small, so as to facilitate the formation of the plating layer 35. The metal thin film layer 32 is formed by sputtering or the like, and thus it is possible to form a metal thin film layer containing no resin.

In addition, according to the present embodiment, the region 341 of the stress relaxation layer 34 is not completely covered by the region 321 of the metal thin film layer 32, such that the region 341 of the stress relaxation layer 34 can be easily deformed, and the thermal stress can be further alleviated.

The Second Embodiment

Figure 17:
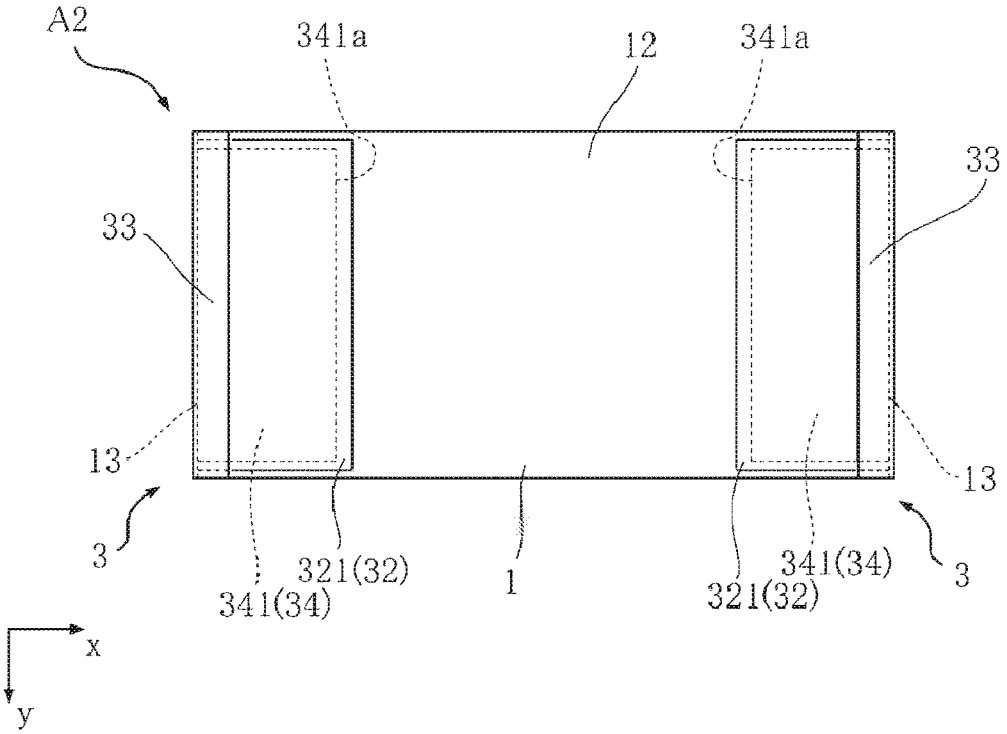
FIG. 17 is a bottom view showing a chip resistor in accordance with the second embodiment of the present invention.
Figure 18A:
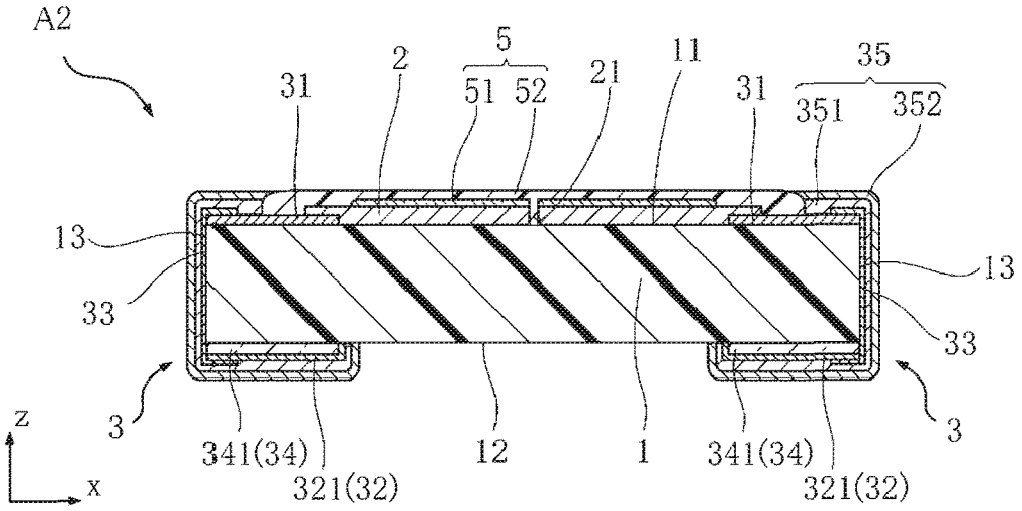
FIGS. 18(*a*) and 18(*b*) are cross sectional view and enlarged cross sectional view respectively showing the chip resistor in FIG. 17.
Figure 18B:
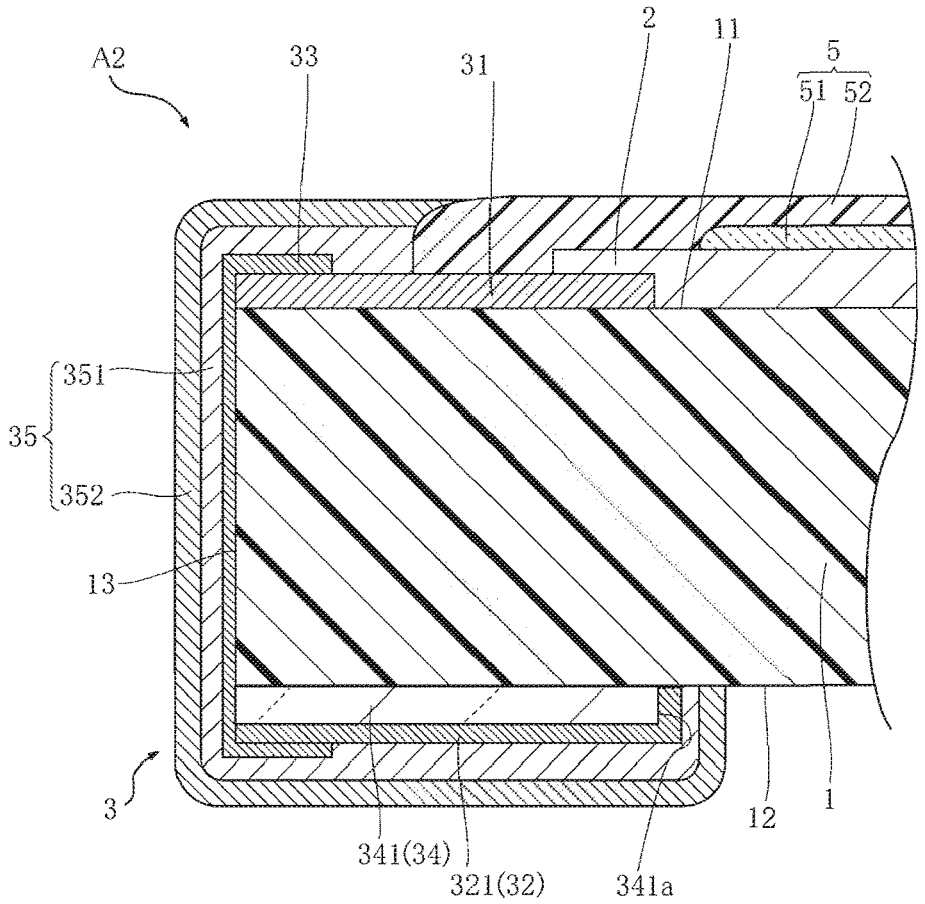
Figure 19A:
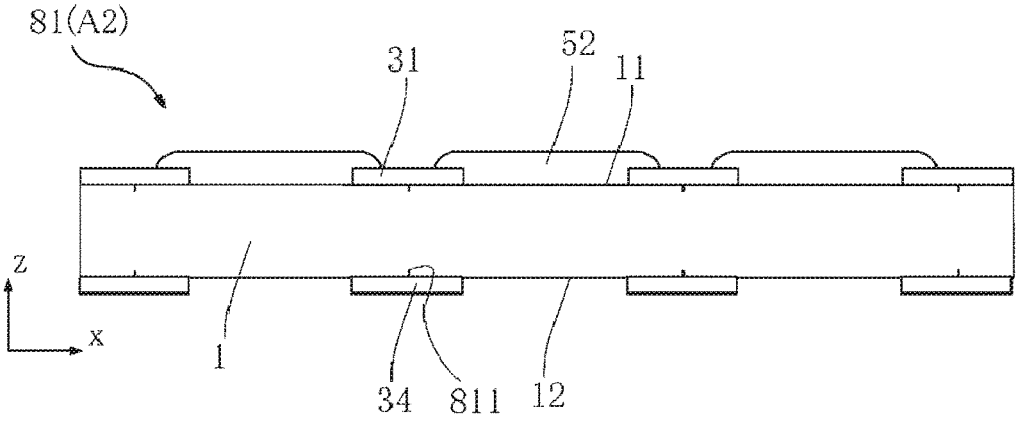
FIGS. 19(*a*)-19(*d*) are front views showing steps of a method for making the chip resistor in FIG. 17.
Figure 19B:
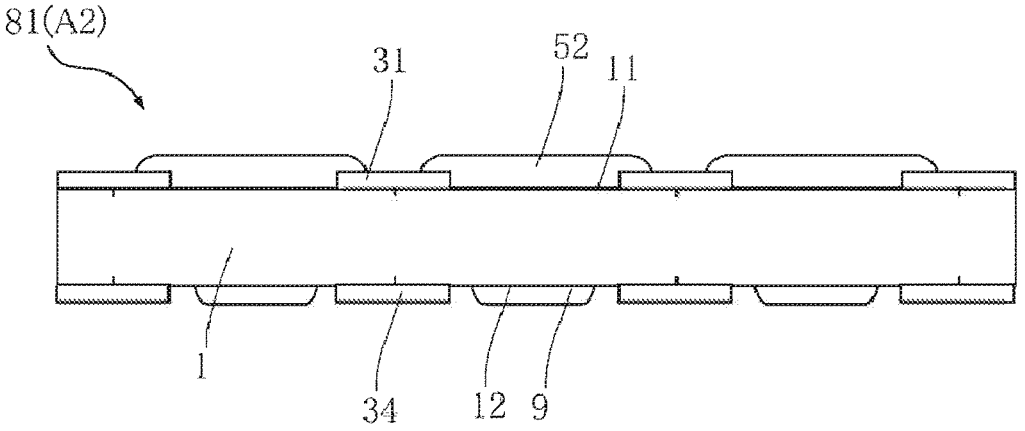
Figure 19C:
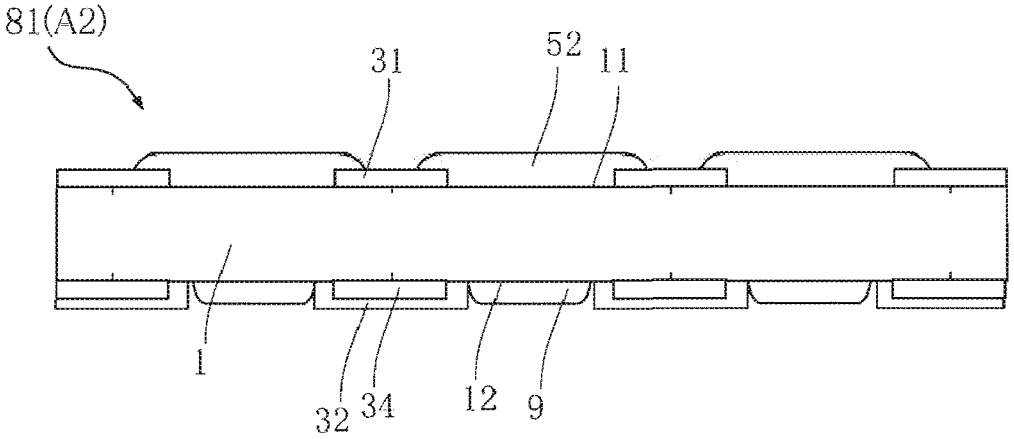
Figure 19D:
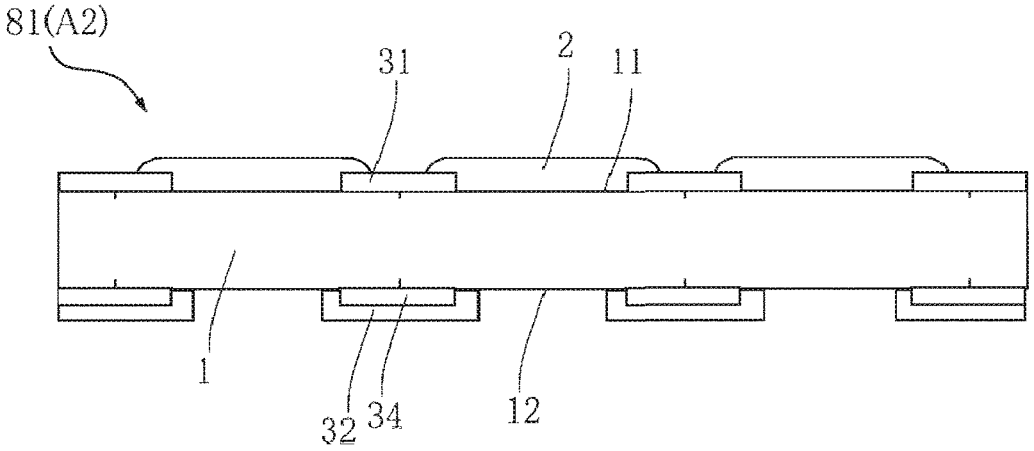

Referring to FIG. 17 to FIG. 19, a chip resistor A2 in the second embodiment of the present invention is illustrated. In these figures, the same or similar elements as those of the chip resistor A1 are denoted by the same reference numerals, and repetition of descriptions is omitted.

FIG. 17 is a bottom view showing the chip resistor A2. In addition, for better understanding, the plating layer 35 is omitted in FIG. 17. FIG. 18(*a*) is a cross sectional view showing the chip resistor A2, and is the same as FIG. 3(*a*) showing the chip resistor A1 of the first embodiment. FIG. 18(*b*) is an enlarged view showing a portion in FIG. 18(*a*). Further, the top view of the chip resistor A2 is the same as that shown in FIG. 1, so is omitted. FIG. 19 is a front view showing steps of the method for making the chip resistor A2.

As shown in FIG. 17 and FIG. 18(*a*) or 18(*b*), the chip resistor A2 in the present embodiment is different from the chip resistor A1 in the following manner, that is, each region 321 of the metal thin film layer 32 also covers the end surfaces 341*a*, facing each other, of each region 341 of the stress relaxation layer 34, each end surface connected to the end surface 341*a*, and the vicinity of these end surfaces (that is, areas other than end surfaces at the opposite side of the end surface 341*a* and the area in contact with the substrate 1).

Subsequently, referring to FIG. 19, the method for making the chip resistor A2 is illustrated. The method of making the chip resistor A2 differs from the method for making the chip resistor A1 in the step of forming the metal thin film layer 32 shown in FIG. 11. Regarding other steps, the method of making the chip resistor A2 is the same as the method of making the chip resistor A1.

With regard to the step of forming a metal thin film layer 32 of the chip resistor A2, as shown in FIG. 19(*b*), the region where the masking film 9 is formed is different from the case where the metal thin film layer 32 of the chip resistor A1 is formed (referring to FIG. 11(*b*)). In the present embodiment, the masking film 9 is formed so that the surface of each stress relaxation layer 34 and the end surfaces are all exposed. Therefore, the metal thin film layer 32 is formed so as to cover the surface and each end surface of each stress relaxation layer 34 (referring to FIG. 19(*c*) and FIG. 19(*d*)).

Then, the effect of the chip resistor A2 is illustrated.

In the present embodiment, similar to the chip resistor A1, the region 341 of the stress relaxation layer 34 with flexibility is formed between the region 321 of the metal thin film layer 32 and the substrate 1. Therefore, the stress resulted from the thermal expansion difference between the substrate 1 and the mounted circuit board can be alleviated by deformation of the region 341 of the stress relaxation layer 34, and thus the generation of cracks is suppressed. Further, the metal thin film layer 32 is formed between the stress relaxation layer 34 and the plating layer 35, so as to facilitate the formation of the plating layer 35. Particularly, the end surface 341*a* of the region 341 of the stress relaxation layer 34, each end surface connected to the end surface 341*a* and the vicinity of these end surfaces, which are not covered in the chip resistor A1, are also covered by the region 321 of the metal thin film layer 32. Hence, there is no region where the plating layer 35 is in direct contact with the stress relaxation layer 34 containing resin, such that the plating layer 35 is more easily formed.

Additionally, the region 321 of the metal thin film layer 32 can cover each end surface of the region 341 of the stress relaxation layer 34 connected to the end surface 341*a*, and the vicinity thereof, but expose the end surface 341*a* and the vicinity thereof. In addition, alternatively, the end surface 341*a* and the vicinity thereof can be covered, with each end surface connected to the end surface 341*a* and the vicinity thereof exposed. In these cases, the region 341 of the stress relaxation layer 34 is not completely covered by the region 321 of the metal thin film layer 32, such that the region 341 of the stress relaxation layer 34 is easily deformed, and thus the thermal stress is further alleviated.

If the portion of the region 341 of the stress relaxation layer 34 covered by the region 321 of the metal thin film layer 32 is smaller, the region 341 of the stress relaxation layer 34 becomes more easily deformed, such that the thermal stress can be further alleviated, but it is difficult to form the plating layer 35. On the other hand, if the portion of the region 341 of the stress relaxation layer 34 covered by the region 321 of the metal thin film layer 32 is larger, the plating layer 35 is more easily formed, but it is difficult to alleviate the thermal stress. The region 321 of the metal thin film layer 32 can be formed to cover the region 341 of the stress relaxation layer 34 in any extent as long as the design is appropriately performed from the viewpoint about alleviation of the thermal stress and the easiness of forming the plating layer 35. However, if the thermal stress applied to the chip resistor A1 (A2) in the x direction (referring to FIG. 16) is considered, it is preferable that the region 321 of the metal thin film layer 32 is formed in the manner that the end surface 341*a* of the region 341 of the stress relaxation layer 34 is exposed.

The Third Embodiment

Referring to FIG. 20 to FIG. 23, a chip resistor A3 in the third embodiment of the present invention is illustrated. In these figures, the same or similar elements as those of the chip resistor A1 are denoted by the same reference numerals, and repetition of descriptions is omitted.

Figure 20:
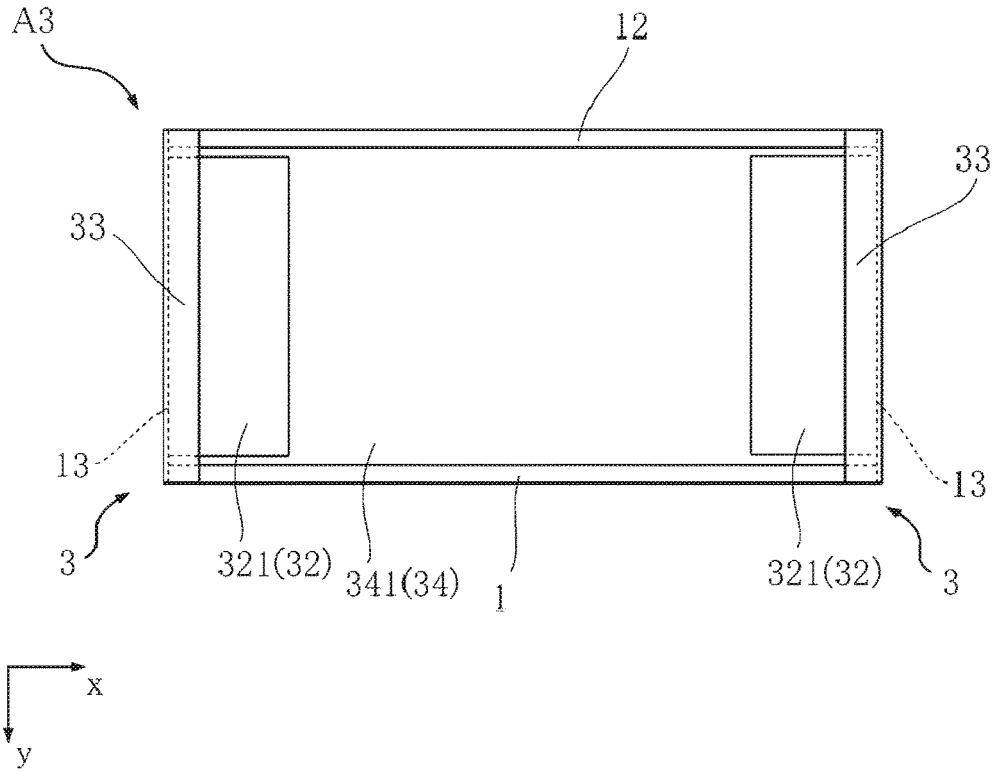
FIG. 20 is a bottom view showing a chip resistor in accordance with the third embodiment of the present invention.
Figure 21A:
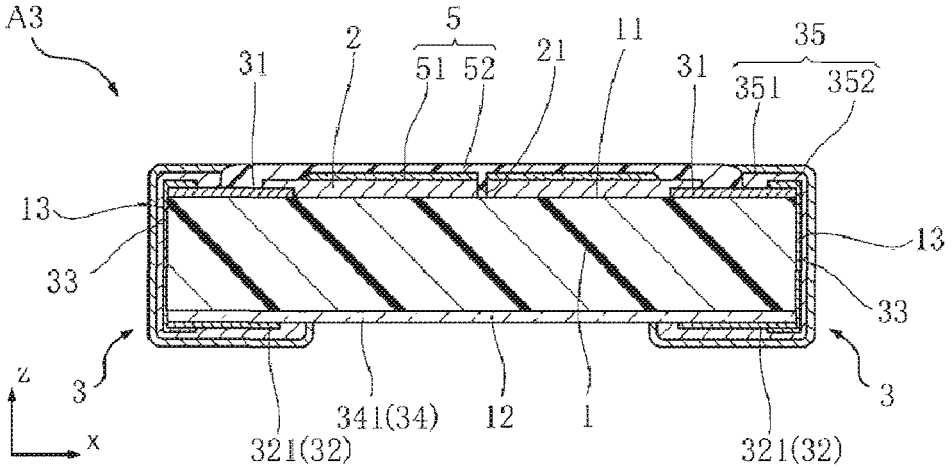
FIGS. 21(*a*) and 21(*b*) are cross sectional view and enlarged cross sectional view respectively showing the chip resistor in FIG. 20.
Figure 21B:
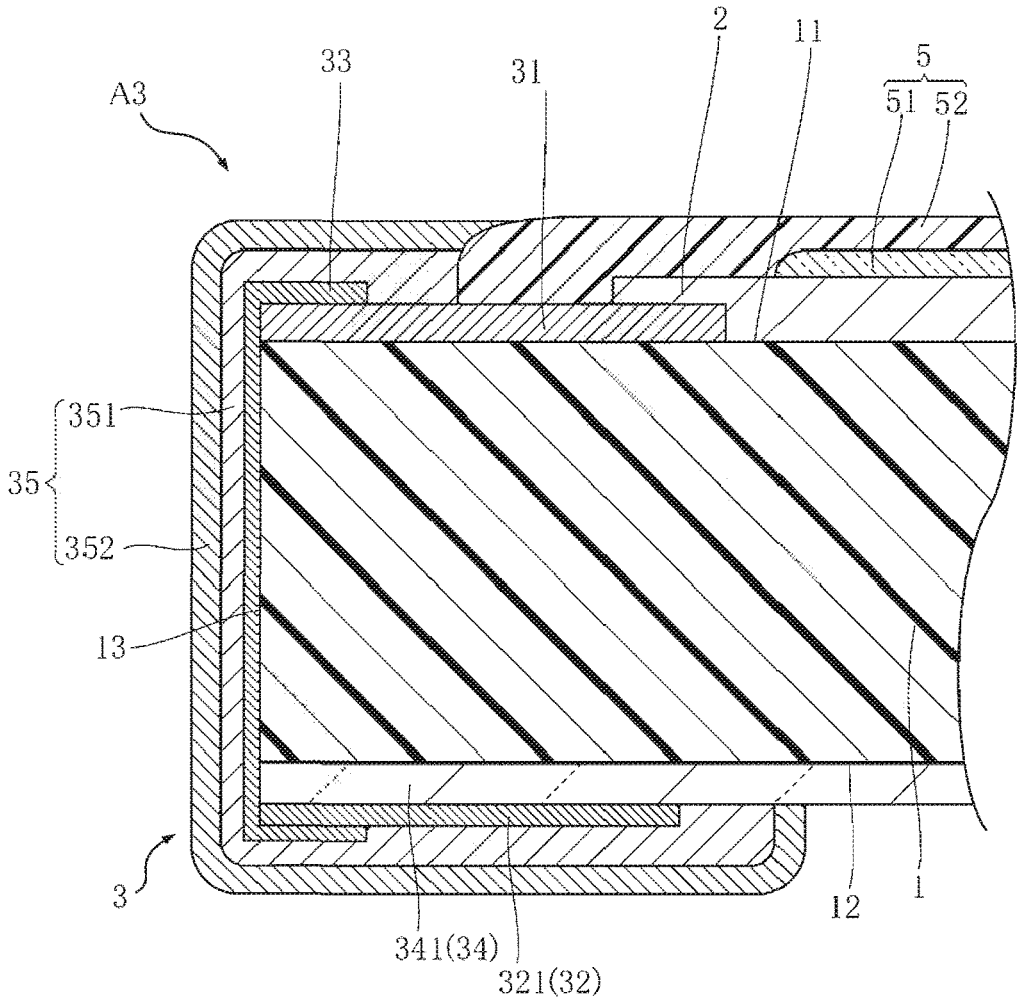
Figure 22:
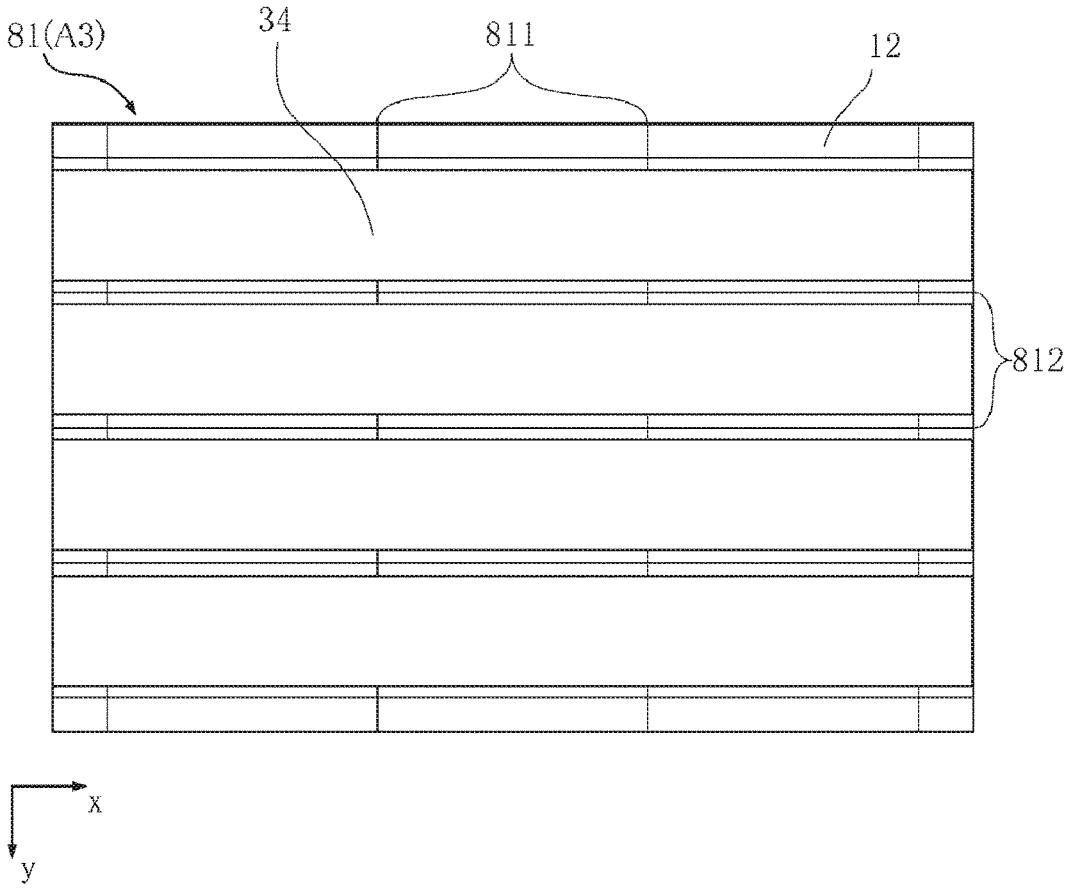
FIG. 22 is a bottom view showing a step of a method for making the chip resistor in FIG. 20.
Figure 23A:
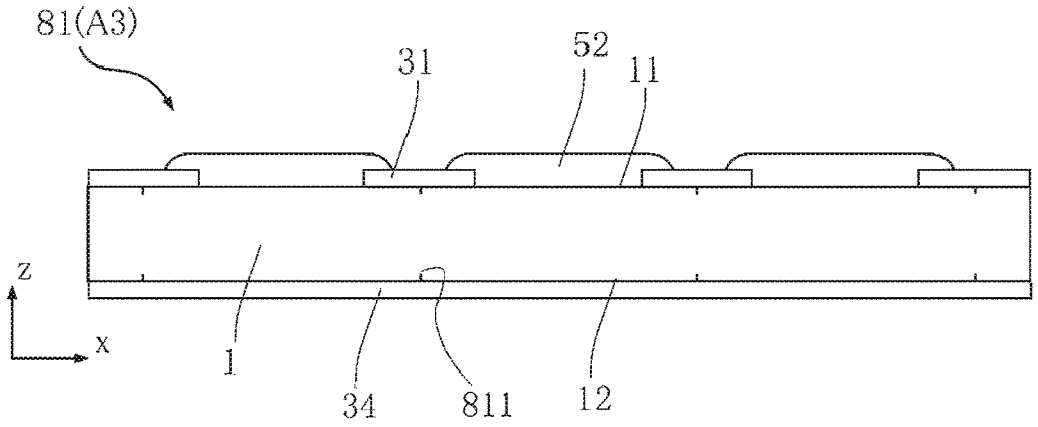
FIGS. 23(*a*)-23(*d*) are front views showing steps of a method for making the chip resistor in FIG. 20.
Figure 23B:
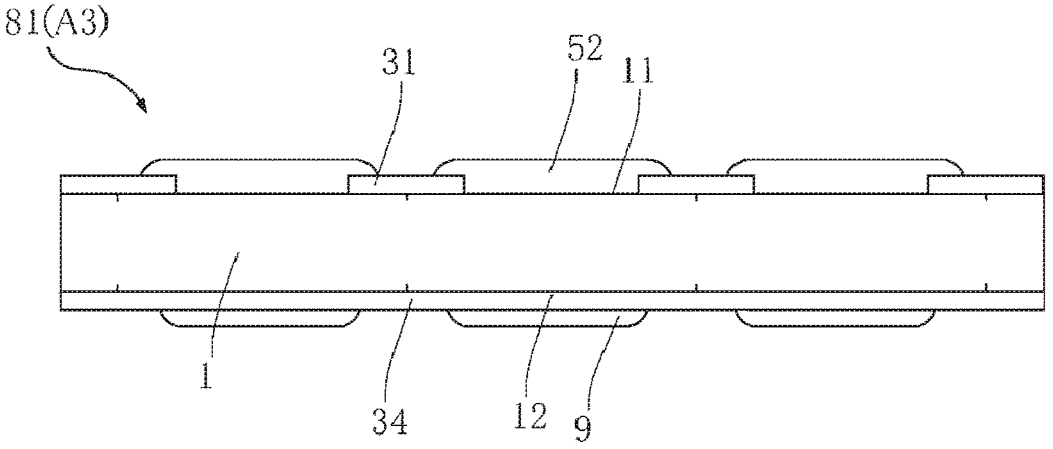
Figure 23C:
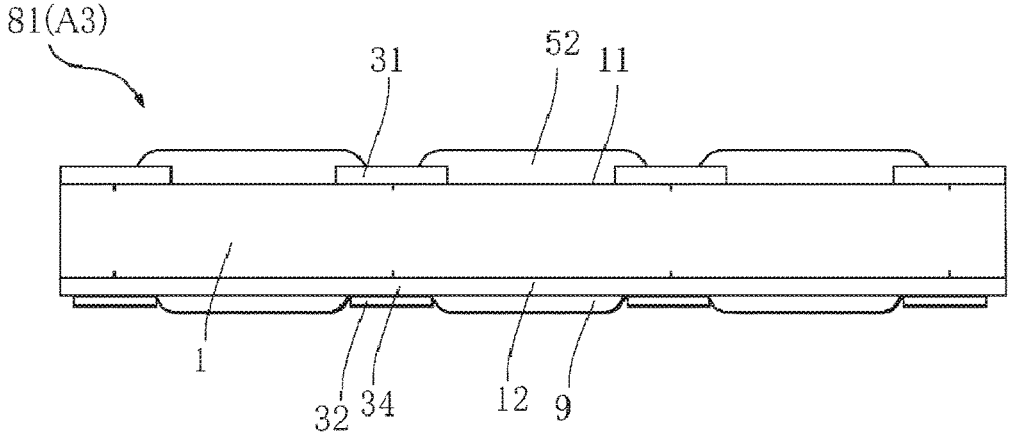
Figure 23D:
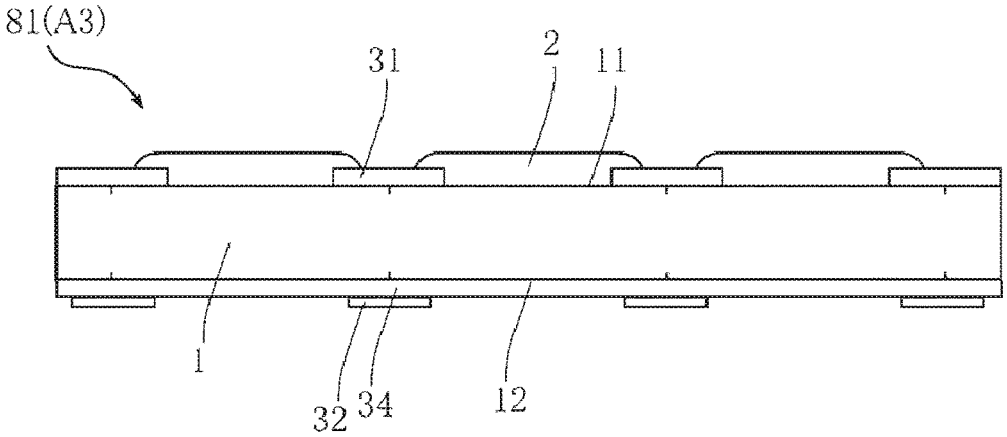

FIG. 20 is a bottom view showing the chip resistor A3. In addition, for better understanding, the plating layer 35 is omitted in FIG. 20. FIG. 21(*a*) is a cross sectional view showing the chip resistor A3, and is the same as FIG. 3(*a*) showing the chip resistor A1 of the first embodiment. FIG. 21(*b*) is an enlarged view showing a portion in FIG. 21(*a*). Further, the top view of the chip resistor A3 is the same as that shown in FIG. 1, so is omitted. FIG. 22 is a bottom view showing steps of the method for making the chip resistor A3. FIG. 23 is a front view showing steps of the method for making the chip resistor A2.

The chip resistor A3 in the present embodiment is different from the chip resistor A1 in the following manner, that is, only one region 341 of the stress relaxation layer 34 is formed from one end of the mounting surface 12 of the substrate 1 to the other end along the longitudinal direction (x direction), rather than forming a pair of regions 341 of the stress relaxation layer 34 at two ends on the mounting surface 12 of the substrate 1. In the present embodiment, the stress relaxation layer 34 should be set as insulating resin.

Subsequently, referring to FIG. 22 and FIG. 23, the method for making the chip resistor A3 is illustrated. The method of making the chip resistor A3 differs from the method of making the chip resistor A1 in the step of forming the stress relaxation layer 34 shown in FIG. 10, and the step of forming the metal thin film layer 32 shown in FIG. 11. With regard to other steps, the method of making the chip resistor A3 is the same as the method of making the chip resistor A1.

In the step of forming the relaxation layer 34 of the chip resistor A2, as shown in FIG. 22, on the mounting surface 12 of the sheet-like substrate 81, a stress relaxation layer 34 is formed form one end to the other end along the longitudinal direction (x direction) in FIG. 22. Then, in the step of forming the metal thin film layer 32 of the chip resistor A2, as shown in FIG. 23, the metal thin film layer 32 is formed on the surface of the stress relaxation layer 34 at the position corresponding to the substrate 1 and each upper electrode 31.

Then, the effect of the chip resistor A3 is illustrated.

In the present embodiment, similar to the chip resistor A1, the region 341 of the stress relaxation layer 34 with flexibility is formed between the region 321 of the metal thin film layer 32 and the substrate 1. Therefore, the stress resulted from the thermal expansion difference between the substrate 1 and the mounted circuit board can be alleviated by deforming the region 341 of the stress relaxation layer 34, so as to suppress the generation of cracks. Further, the metal thin film layer 32 is formed between the stress relaxation layer 34 and the plating layer 35, so as to facilitate the formation of the plating layer 35. In addition, since the region 341 of the stress relaxation layer 34 is not completely covered by the region 321 of the metal thin film layer 32, the region 341 of the stress relaxation layer 34 is more easily deformed, and the thermal stress is further alleviated. Furthermore, since the formation of the stress relaxation layer 34 is easier (referring to FIG. 22), the manufacturing process can be simplified.

In addition, the region 341 of the stress relaxation layer 34 can also be formed on all surface of the mounting surface 12 of the substrate 1. In this case, in the step of forming the stress relaxation layer 34 (referring to FIG. 22), the stress relaxation layer 34 is formed on all surface of the mounting surface 12 of the sheet-like substrate 81. Therefore, the formation of the stress relaxation layer 34 becomes easier, such that the manufacturing process can be further simplified.

The Fourth Embodiment

Figure 24:
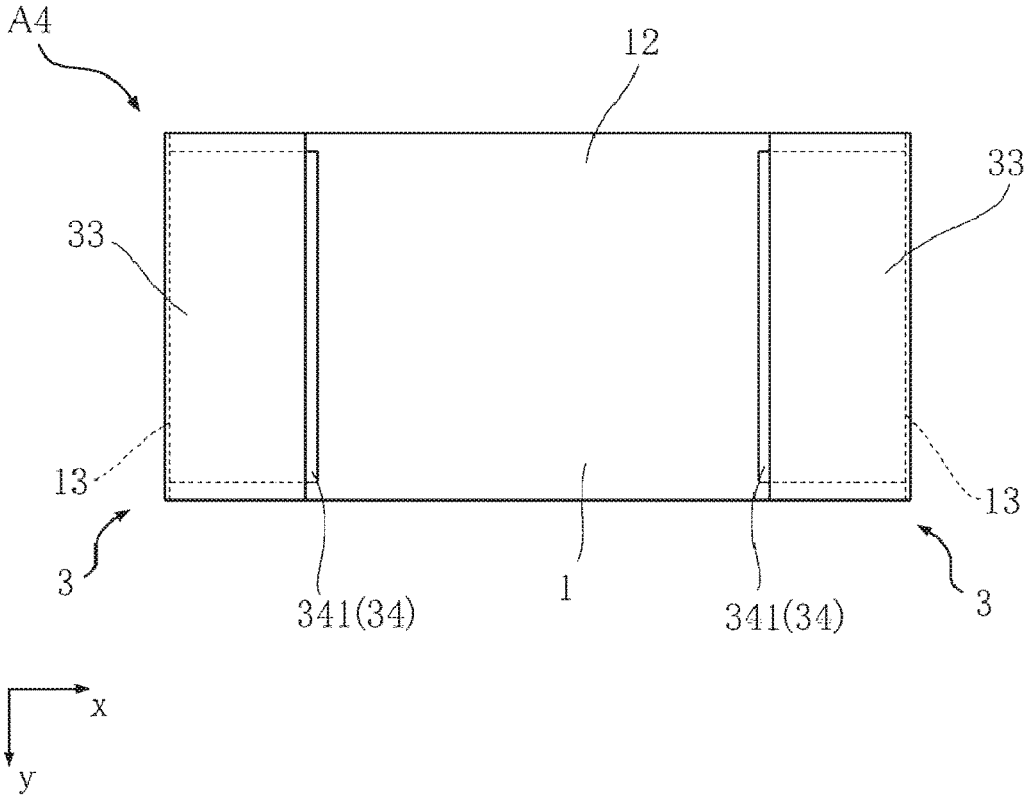
FIG. 24 is a bottom view showing a chip resistor in accordance with the fourth embodiment of the present invention.
Figure 25A:
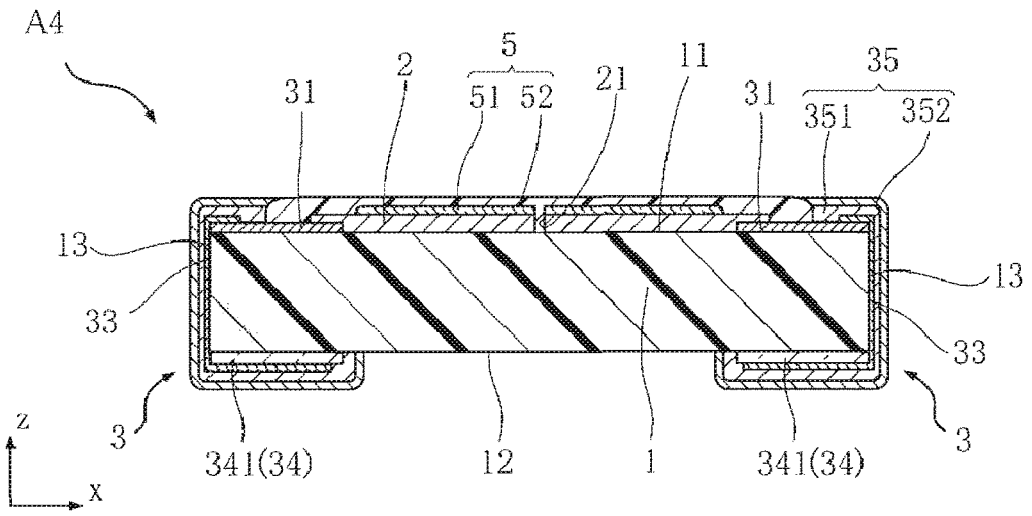
FIGS. 25(*a*) and 25(*b*) are cross sectional view and enlarged cross sectional view respectively showing the chip resistor in FIG. 24.
Figure 25B:
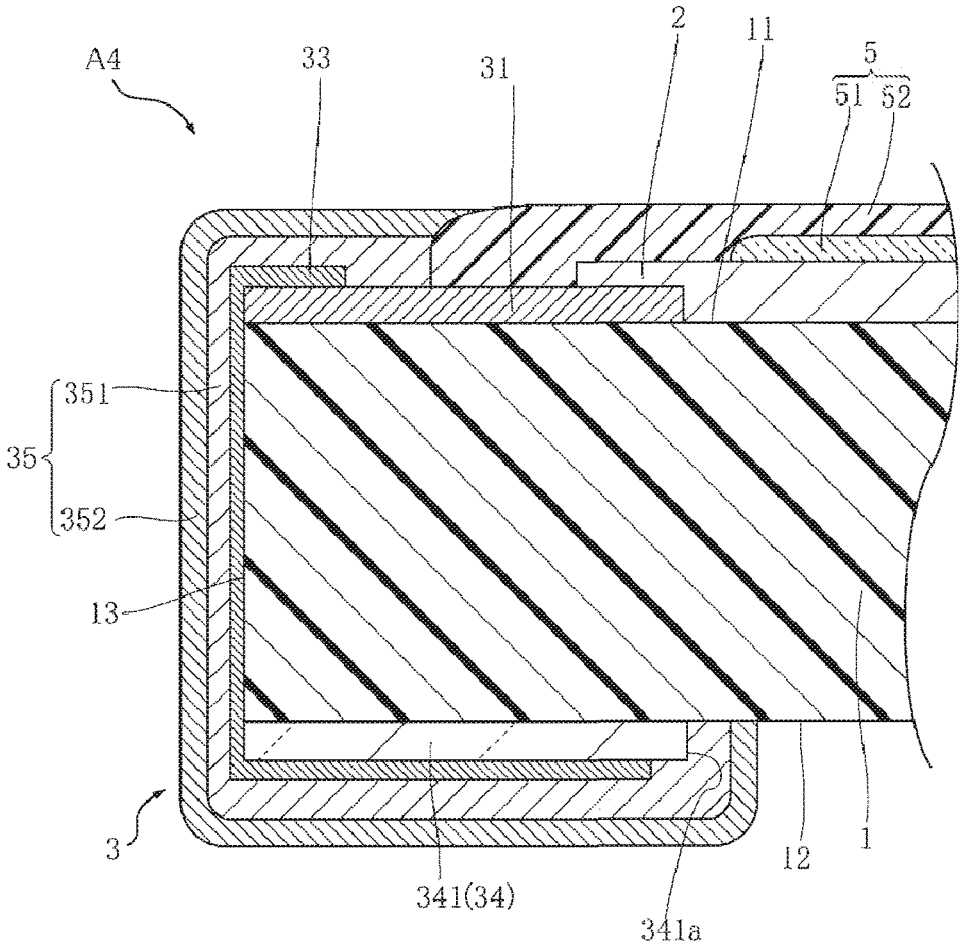

Referring to FIG. 24 and FIG. 25(*a*) or 25(*b*), a chip resistor A4 of the fourth embodiment in the present invention is illustrated. In these figures, the same or similar elements as those of the chip resistor A1 are denoted by the same reference numerals, and repetition of descriptions is omitted.

FIG. 24 is a bottom view showing the chip resistor A4. In addition, for better understanding, the plating layer 35 is omitted in FIG. 24. FIG. 25(*a*) is a cross sectional view showing the chip resistor A4, and is the same as FIG. 3(*a*) showing the chip resistor A1 of the first embodiment. FIG. 25(*b*) is an enlarged view showing a portion in FIG. 25(*a*). Further, the top view of the chip resistor A4 is the same as that shown in FIG. 1, so is omitted.

The chip resistor A4 in the present embodiment is different from the chip resistor A1 in the following manner, that is, there is no metal thin film layer 32, and the side electrode 33 is also used as the metal thin film layer 32. In the present embodiment, regarding the side electrode 33, a portion on the mounting surface 12 side of the substrate 1 extend in parallel with the mounting surface 12 until the vicinity of the end surface 341*a* of the region 341 of the stress relaxation layer 34. In addition, the side electrode 33, similarly to the metal thin film layer 32, is formed by forming a Ni—Cr alloy film, for example, by physical vapor deposition based on sputtering or the like. In the present embodiment, the portion of the side electrode 33 formed on the side surface 13 corresponds to "a second sputtered layer" of the present invention and the extending portion of the side electrode 33 on the mounting surface 12 side corresponds to "a sputtered layer" of the present invention.

Then, the method of making the chip resistor A4 is illustrated. The chip resistor A4 in the present embodiment is different from the chip resistor A1 in the following manner, that is, the step of forming the metal thin film layer 32 in FIG. 11 is omitted, and the step of forming the side electrode 33 in FIG. 13 is by physical vapor deposition based on sputtering or the like. Regarding other steps, the method of making the chip resistor A4 is the same as the method of making the chip resistor A1.

Then, the effect of the chip resistor A4 is illustrated.

In the present embodiment, the region 341 of the stress relaxation layer 34 with flexibility is formed between the portion of the side electrode 33 on the mounting surface 12 side and the substrate 1, and the portion of the side electrode 33 on the mounting surface 12 side corresponds to the region 321 of the metal thin film layer 32 of the chip resistor A1. Therefore, in the present embodiment, the stress resulted from the thermal expansion difference between the substrate 1 and the mounted circuit board can also be alleviated by deforming the region 341 of the stress relaxation layer 34, so as to suppress the generation of cracks. Further, the portion of the side electrode 33 on the mounting surface 12 side is formed between the stress relaxation layer 34 and the plating layer 35, so as to facilitate the formation of the plating layer 35. In addition, since the region 341 of the stress relaxation layer 34 is not completely covered by the portion of the side electrode 33 on the mounting surface 12 side, the region 341 of the stress relaxation layer 34 is more easily deformed, and the thermal stress is further alleviated. Furthermore, since the step of forming the metal thin film layer 32 shown in FIG. 11 can be omitted, the manufacturing process can be simplified.

The Fifth Embodiment

Figure 26:
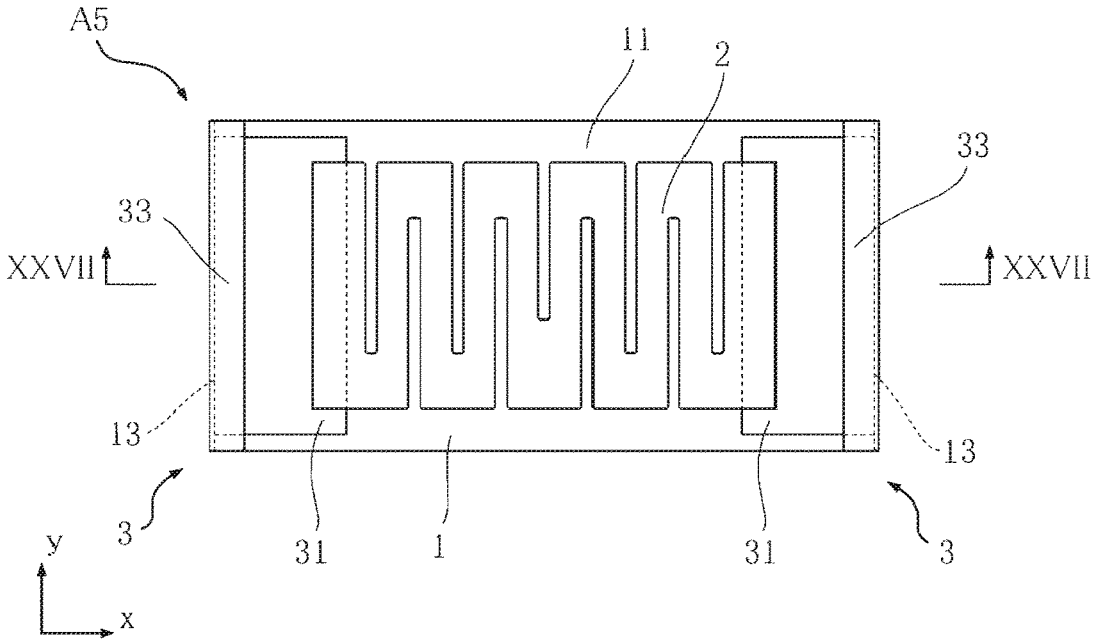
FIG. 26 is a top view showing a chip resistor in accordance with the fifth embodiment of the present invention.
Figure 27:
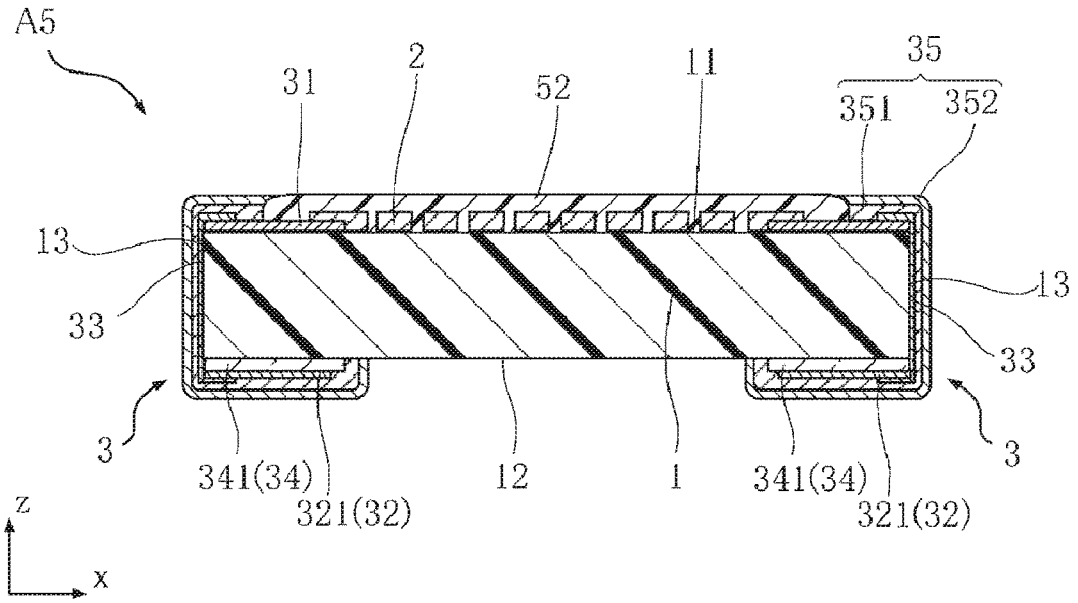
FIG. 27 is a cross sectional view along line XXVII-XXVII in FIG. 26.
Figure 28:
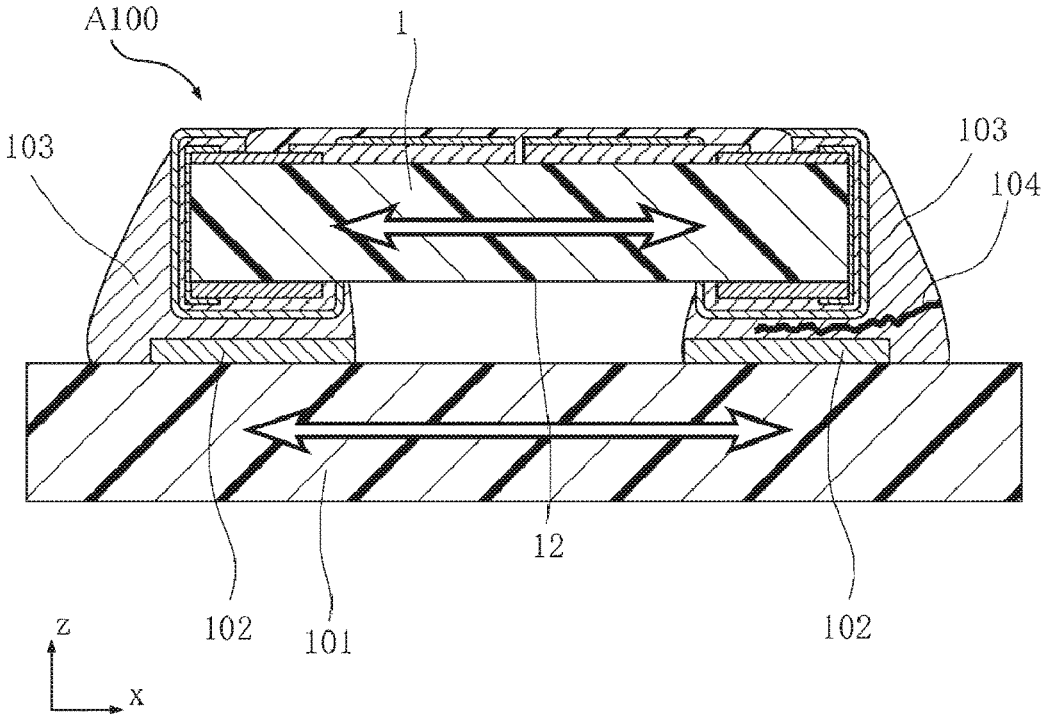
FIG. 28 is a cross sectional view showing the status that the conventional chip resistor is mounted on a circuit board.

Referring to FIG. 26 and FIG. 27, a chip resistor A5 of the fifth embodiment in the present invention is illustrated. In these figures, the same or similar elements as those of the chip resistor A1 are denoted by the same reference numerals, and repetition of descriptions is omitted.

FIG. 26 is a top view showing the chip resistor A5. Further, for better understanding, the plating layer 35 and the protective film 5 are omitted in FIG. 26. FIG. 27 is a cross sectional view along line XXVII-XXVII in FIG. 26. In addition, the bottom view of the chip resistor A5 is the same as that in FIG. 2, and thus is omitted.

The shape of the resistor 2, as viewed from a top view, and the configuration of the protective film 5 of the chip resistor A5 in the present embodiment are different from those of the chip resistor A1. In the present embodiment, the resistor 2 is of a serpentine shape as viewed from a top view. The resistor 2 of this shape can be formed by the method of photolithography after the resistor 2 is carried on the carrying surface 11 of the substrate 1 by physical vapor deposition based on sputtering or the like. In this case, the resistor 2 includes a Ni—Cr alloy or the like, for example. That is, the chip resistor A5 in the present embodiment is a so-called thin film chip resistor. Additionally, in the present embodiment, the lower protective film 51 of the protective film 5 is omitted.

Then, the effect of the chip resistor A5 is illustrated.

In the present embodiment, similar to the chip resistor A1, the region 341 of the stress relaxation layer 34 with flexibility is formed between the region 321 of the metal thin film layer 32 and the substrate 1. Therefore, the stress resulted from the thermal expansion difference between the substrate 1 and the mounted circuit board can be alleviated by deforming the region 341 of the stress relaxation layer 34, so as to suppress the generation of cracks. Further, the metal thin film layer 32 is formed between the stress relaxation layer 34 and the plating layer 35, so as to facilitate the formation of the plating layer 35. In addition, since the region 341 of the stress relaxation layer 34 is not completely covered by the region 321 of the metal thin film layer 32, the region 341 of the stress relaxation layer 34 is more easily deformed, and the thermal stress can be further alleviated. Furthermore, by setting the resistor 2 to be of a serpentine shape as viewed from a top view, the resistance value of the chip resistor A5 can be relatively increased as compared with the chip resistor A1, and the accuracy of the resistance value can be improved.

The chip resistor and the method of making the same in the present invention are not limited to the above-described embodiments. The specific configuration of each part of the chip resistor and the method of making the same in the present invention can be freely designed and changed.

What is claimed is:

1. A chip resistor, comprising:

a substrate having a carrying surface and a mounting surface facing away from each other;

a pair of upper electrodes disposed at two ends of the carrying surface of the substrate;

a resistor mounted on the carrying surface of the substrate, and between the pair of upper electrodes, the resistor being electrically connected to the pair of upper electrodes;

a stress relaxation layer having flexibility and formed on the mounting surface of the substrate;

a metal thin film layer formed on a surface of the stress relaxation layer opposite to the substrate and having a pair of regions spaced apart in a first direction;

a pair of side electrodes for electrically connecting the pair of upper electrodes and the pair of regions of the metal thin film layer, and a portion of the metal thin film layer is covered by one of the side electrodes; and a plating layer covering the side electrode and the metal thin film layer.

2. The chip resistor of claim 1, wherein the stress relaxation layer comprises silicone resin or epoxy resin.

3. The chip resistor of claim 1, wherein the stress relaxation layer comprises conductive resin.

4. The chip resistor of claim 1, wherein the stress relaxation layer is formed on all of the mounting surface of the substrate.

5. The chip resistor of claim 1, wherein the stress relaxation layer comprises a pair of regions spaced apart from each other in the first direction and formed respectively at two ends of the mounting surface of the substrate.

6. The chip resistor of claim 5, wherein end surfaces of each of the regions of the stress relaxation layer, facing each other in the first direction, are exposed by each of the regions of the metal thin film layer, and each of the regions of the metal thin film layer covers a part of each of the regions of the stress relaxation layer.

7. The chip resistor of claim 5, wherein end surfaces of each of the regions of the stress relaxation layer, facing each other in the first direction, are covered by each of the regions of the metal thin film layer.

8. The chip resistor of claim 1, wherein the metal thin film layer comprises Ni—Cr alloy.

9. The chip resistor of claim 1, wherein the metal thin film layer comprises a sputtered layer.

10. The chip resistor of claim 9, wherein the side electrode comprises a second sputtered layer formed on a side surface of the substrate between the carrying surface and the mounting surface of the substrate; wherein the sputtered layer and the second sputtered layer are integrally formed.

11. The chip resistor of claim 1, wherein the side electrode comprises:

a portion disposed on a side surface of the substrate between the carrying surface and the mounting surface of the substrate; and a portion overlapping with the carrying surface and the mounting surface in a thickness direction of the substrate.

12. The chip resistor of claim 1, wherein the side electrode comprises Ni—Cr alloy.

13. The chip resistor of claim 1, wherein the plating layer comprises a Ni plating layer and a Sn plating layer.

14. The chip resistor of claim 1, wherein a thickness of the stress relaxation layer is 10-50 μm.

15. The chip resistor of claim 1, wherein the substrate is an electrical insulator.

16. The chip resistor of claim 15, wherein the substrate comprises alumina.

17. The chip resistor of claim 1, wherein the resistor is of a serpentine shape as viewed from a top view.

18. The chip resistor of claim 1, wherein the resistor comprises RuO2 or Ag—Pd alloy.

19. The chip resistor of claim 1, wherein the resistor has a trimming groove penetrating in a thickness direction.

20. The chip resistor of claim 1, further comprising a protective film covering the resistor and a part of the upper electrode.

21. The chip resistor of claim 20, wherein the protective film has a lower protective film and an upper protective film.

22. The chip resistor of claim 21, wherein the lower protective film comprises glass.

23. The chip resistor of claim 21, wherein the upper protective film comprises epoxy resin.

24. A method of making a chip resistor, comprising:

preparing a sheet-like substrate with a carrying surface and a mounting surface facing away from each other, and forming a pair of upper electrodes spaced apart from one another on the carrying surface of the sheet-like substrate;

mounting a resistor electrically connected to the upper electrodes in a region of the carrying surface of the sheet-like substrate sandwiched between the pair of upper electrodes;

forming a stress relaxation layer having flexibility on the mounting surface;

forming a metal thin film layer having a pair of regions on a surface of the stress relaxation layer opposite to the sheet-like substrate;

dividing the sheet-like substrate into a plurality of strip-shaped substrates with short sides in a direction in which the pair of upper electrodes are separated;

forming a pair of side electrodes for electrically connecting the pair of upper electrodes and the pair of regions of the metal thin film layer, on a side surface along two ends in a longitudinal direction of the strip-shaped substrate, the mounting surface, and the mounting surface; and forming a plating layer covering the side electrodes and the metal thin film layer.

25. The method of making a chip resistor of claim 24, wherein forming the metal thin film layer is by physical vapor deposition.

26. The method of making a chip resistor of claim 25, wherein the physical vapor deposition is sputtering.

27. The method of making a chip resistor of claim 24, wherein the resistor is mounted by printing, or physical vapor deposition and photolithography.

28. The method of making a chip resistor of claim 24, further comprising dividing the strip-shaped substrate into a plurality of pieces before forming the plating layer.

29. The method of making a chip resistor of claim 24, further comprising forming a trimming groove through the resistor.

30. The method of making a chip resistor of claim 24, further comprising forming a protective film covering the resistor and a portion of the upper electrode.

31. A chip resistor, comprising:

a substrate having a carrying surface and a mounting surface facing away from each other;

a pair of upper electrodes disposed at two ends of the carrying surface of the substrate;

a resistor mounted on the carrying surface of the substrate, and between the pair of upper electrodes, the resistor being electrically connected to the pair of upper electrodes;

a stress relaxation layer with flexibility formed on the mounting surface of the substrate, and having a pair of regions spaced apart from each other in the first direction and formed respectively at two ends of the mounting surface of the substrate;

a metal thin film layer formed on a surface of the stress relaxation layer opposite to the substrate and having a pair of regions spaced apart in a first direction;

a pair of side electrodes for electrically connecting the pair of upper electrodes and the pair of regions of the metal thin film layer; and a plating layer covering the side electrode and the metal thin film layer, wherein end surfaces of each of the regions of the stress relaxation layer, facing each other in the first direction, are covered by each of the regions of the metal thin film layer.

32. The chip resistor of claim 31, wherein the stress relaxation layer comprises silicone resin or epoxy resin.

33. The chip resistor of claim 31, wherein the stress relaxation layer comprises conductive resin.

34. The chip resistor of claim 31, wherein the stress relaxation layer is formed on all of the mounting surface of the substrate.

35. The chip resistor of claim 31, wherein end surfaces of each of the regions of the stress relaxation layer, facing each other in the first direction, are exposed by each of the regions of the metal thin film layer, and each of the regions of the metal thin film layer covers a part of each of the regions of the stress relaxation layer.

36. The chip resistor of claim 31, wherein the metal thin film layer comprises Ni—Cr alloy.

37. The chip resistor of claim 31, wherein the metal thin film layer comprises a sputtered layer.

38. The chip resistor of claim 37, wherein the side electrode comprises a second sputtered layer formed on a side surface of the substrate between the carrying surface and the mounting surface of the substrate; wherein the sputtered layer and the second sputtered layer are integrally formed.

39. The chip resistor of claim 31, wherein the side electrode comprises:

a portion disposed on a side surface of the substrate between the carrying surface and the mounting surface of the substrate; and a portion overlapping with the carrying surface and the mounting surface in a thickness direction of the substrate.

40. The chip resistor of claim 31, wherein the side electrode comprises Ni—Cr alloy.

41. The chip resistor of claim 31, wherein the plating layer comprises a Ni plating layer and a Sn plating layer.

42. The chip resistor of claim 31, wherein a thickness of the stress relaxation layer is 10-50 μm.

43. The chip resistor of claim 31, wherein the substrate is an electrical insulator.

44. The chip resistor of claim 43, wherein the substrate comprises alumina.

45. The chip resistor of claim 31, wherein the resistor is of a serpentine shape as viewed from a top view.

46. The chip resistor of claim 31, wherein the resistor comprises RuO2 or Ag—Pd alloy.

47. The chip resistor of claim 31, wherein the resistor has a trimming groove penetrating in a thickness direction.

48. The chip resistor of claim 31, further comprising a protective film covering the resistor and a part of the upper electrode.

49. The chip resistor of claim 48, wherein the protective film has a lower protective film and an upper protective film.

50. The chip resistor of claim 49, wherein the lower protective film comprises glass.

51. The chip resistor of claim 49, wherein the upper protective film comprises epoxy resin.

* * * * *